US010919318B2

(12) United States Patent
Tamaki et al.

(10) Patent No.: US 10,919,318 B2
(45) Date of Patent: Feb. 16, 2021

(54) PRETREATMENT DEVICE AND PRETREATMENT INFORMATION SETTING METHOD

(71) Applicant: BROTHER KOGYO KABUSHIKI KAISHA, Nagoya (JP)

(72) Inventors: Shuichi Tamaki, Nagoya (JP); Takeshi Watanabe, Nagoya (JP); Kenji Sato, Yokkaichi (JP)

(73) Assignee: BROTHER KOGYO KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/141,376

(22) Filed: Sep. 25, 2018

(65) Prior Publication Data

US 2019/0193424 A1 Jun. 27, 2019

(30) Foreign Application Priority Data

Dec. 27, 2017 (JP) ..... JP2017-252361

(51) Int. Cl.
*B41J 11/00* (2006.01)
*D06C 15/10* (2006.01)
(Continued)

(52) U.S. Cl.
CPC ..... *B41J 11/002* (2013.01); *B41J 3/4078* (2013.01); *B41J 11/009* (2013.01);
(Continued)

(58) Field of Classification Search
CPC ..... B41J 11/002; B41J 11/009; B41J 3/4078; B41J 11/06; B41J 11/0015; D06P 5/30;
(Continued)

(56) References Cited

U.S. PATENT DOCUMENTS 9,465,563 B2 * 10/2016 Kawaguchi ..... H04N 1/00633
2005/0243121 A1 * 11/2005 Onishi ..... B41J 2/2114 347/21

(Continued)

FOREIGN PATENT DOCUMENTS

JP 2013-019083 A 1/2013

OTHER PUBLICATIONS

New U.S. patent application claiming priority to JP Application No. 2017-252373 being filed concurrently on Sep. 25, 2018 (Client Reference Nos. 2017-01438US00/17310BRY21). (52 pages).

(Continued)

*Primary Examiner* — Huan H Tran
*Assistant Examiner* — Alexander D Shenderov
(74) *Attorney, Agent, or Firm* — K&L Gates LLP

(57) ABSTRACT

A pretreatment device includes a pretreatment portion, a reception portion, a processor and a memory. The pretreatment portion performs a pretreatment on a recording medium. The reception portion receives recording medium information that the recording medium has. The memory stores computer-readable instructions that, when executed by the processor, perform processes including: setting, for the pretreatment portion, pretreatment information relating to the pretreatment, on the basis of the recording medium information received by the reception portion; and causing the pretreatment portion to perform the pretreatment on the basis of the set pretreatment information.

17 Claims, 20 Drawing Sheets

(51) Int. Cl.

| | |
|---|---|
| ***D06B 11/00*** | (2006.01) |
| ***B41J 11/06*** | (2006.01) |
| ***B41J 3/407*** | (2006.01) |
| ***B41M 5/00*** | (2006.01) |
| ***D06P 5/30*** | (2006.01) |

(52) U.S. Cl.
CPC ..... *B41J 11/0015* (2013.01); *B41J 11/06* (2013.01); *B41M 5/0017* (2013.01); *D06B 11/0059* (2013.01); *D06C 15/10* (2013.01); *D06P 5/30* (2013.01)

(58) Field of Classification Search
CPC ... B41M 5/0017; D06B 11/0059; D06C 15/10
USPC ..... 347/101
See application file for complete search history.

(56) References Cited

U.S. PATENT DOCUMENTS

2006/0214984 A1* 9/2006 Hirakawa ..... B41J 2/2114 347/31
2006/0275066 A1* 12/2006 Mima ..... B41J 3/46 400/76
2008/0016090 A1 1/2008 Fukata
2013/0061767 A1* 3/2013 Casals ..... B41J 11/0015 101/202
2013/0265359 A1* 10/2013 Sugaya ..... B41J 11/002 347/16
2016/0368286 A1* 12/2016 Rossinyol Casals ..... B41J 11/0015
2017/0151810 A1* 6/2017 Kamibayashi ..... B41J 11/009

OTHER PUBLICATIONS

Non-Final Office Action issued in connection with related U.S. Appl. No. 16/141,416, dated Nov. 18, 2019. (14 pages).

Final Office Action dated Jun. 15, 2020 in corresponding U.S. Appl. No. 16/141,416. (13 pages).

Advisory Action dated Aug. 5, 2020 in corresponding U.S. Appl. No. 16/141,376.

* cited by examiner

FIG. 5

81

| | | | | | |
|---|---|---|---|---|---|
| APPLICATION TREATMENT INFORMATION | APPLICATION AMOUNT PER UNIT AREA (mg/cm$^2$) | C1 | C2 | C3 | ・・・ |
| | APPLICATION RANGE | CR1 | CR1 | CR1 | ・・・ |
| | TYPE OF PRETREATMENT AGENT | L1 | L2 | L3 | ・・・ |
| HEAT TREATMENT INFORMATION | HEAT TREATMENT PRESSURE (N/cm$^2$) | P1 | P2 | P3 | ・・・ |
| | HEAT TREATMENT TIME PERIOD (sec) | T1 | T2 | T3 | ・・・ |
| | HEAT TREATMENT TEMPERATURE (℃) | TP1 | TP2 | TP3 | ・・・ |
| | HEAT TREATMENT RANGE | PR1 | PR1 | PR1 | ・・・ |
| | NUMBER OF TIMES OF HEAT TREATMENT | NT1 | NT2 | NT3 | ・・・ |

FIG. 6

82

| SPRAY | (1) | (2) | (3) | (4) | (5) | (6) | (7) |
|---|---|---|---|---|---|---|---|
| APPLICATION SECTION | [0, a] | [a, b] | [b, c] | [c, d] | [d, e] | [e, f] | [f, g] |

FIG. 10

83

| IDENTIFIER | PRETREATMENT INFORMATION |
|---|---|
| ID1 | PRETREATMENT INFORMATION 1 |
| ID2 | PRETREATMENT INFORMATION 2 |
| ID3 | PRETREATMENT INFORMATION 3 |
| ID4 | PRETREATMENT INFORMATION 4 |
| ID5 | PRETREATMENT INFORMATION 5 |
| ID6 | PRETREATMENT INFORMATION 6 |
| ⋮ | ⋮ |

FIG. 11

84

| | | |
|---|---|---|
| APPLICATION TREATMENT INFORMATION | APPLICATION AMOUNT PER UNIT AREA ($mg/cm^2$) | C1 |
| | APPLICATION RANGE | CR1 |
| | TYPE OF PRETREATMENT AGENT | L1 |
| HEAT TREATMENT INFORMATION | HEAT TREATMENT PRESSURE ($N/cm^2$) | P1 |
| | HEAT TREATMENT TIME PERIOD (sec) | T1 |
| | HEAT TREATMENT TEMPERATURE (℃) | TP1 |
| | HEAT TREATMENT RANGE | PR1 |
| | NUMBER OF TIMES OF HEAT TREATMENT | NT1 |

FIG. 13

85

| | | | | | |
|---|---|---|---|---|---|
| MANUFACTURER | MK1 | MK1 | MK1 | MK2 | ・・・ |
| BRAND | BR1 | BR1 | BR2 | BR1 | ・・・ |
| MODEL NUMBER | TN1 | TN1 | TN2 | TN3 | ・・・ |
| FABRIC THICKNESS (WEIGHT PER UNIT AREA) | TH1 | TH1 | TH2 | TH3 | ・・・ |
| MATERIAL | MT1 | MT1 | MT2 | MT3 | ・・・ |
| KNIT/WEAVE | WE1 | WE1 | WE2 | WE3 | ・・・ |
| COLOR | CL1 | CL2 | CL3 | CL4 | ・・・ |
| LOT | LT1 | LT2 | LT1 | LT1 | ・・・ |
| PRETREATMENT INFORMATION | 1 | 2 | 3 | 4 | ・・・ |

FIG. 14

86

| COLOR | CL3 | CL7 | CL13 | · · · |
|---|---|---|---|---|
| BRIGHTNESS THRESHOLD VALUE | BN | | | |

FIG. 16

87

| IDENTIFIER | ID1 | ID2 | ID3 | ID4 | ・・・ |
|---|---|---|---|---|---|
| MANUFACTURER | MK1 | MK1 | MK1 | MK2 | ・・・ |
| BRAND | BR1 | BR1 | BR2 | BR1 | ・・・ |
| MODEL NUMBER | TN1 | TN1 | TN2 | TN3 | ・・・ |
| FABRIC THICKNESS (WEIGHT PER UNIT AREA) | TH1 | TH1 | TH2 | TH3 | ・・・ |
| MATERIAL | MT1 | MT1 | MT2 | MT3 | ・・・ |
| KNIT/WEAVE | WE1 | WE1 | WE2 | WE3 | ・・・ |
| COLOR | CL1 | CL2 | CL3 | CL4 | ・・・ |
| LOT | LT1 | LT2 | LT1 | LT1 | ・・・ |
| PRETREATMENT INFORMATION | 1 | 2 | 3 | 4 | ・・・ |

FIG. 19

88

| IDENTIFIER | PRINT DATA |
|---|---|
| ID1 | PRD1 |
| ID2 | PRD2 |
| ID3 | PRD3 |
| ID4 | PRD4 |
| ID5 | PRD5 |
| ID6 | PRD6 |
| ⋮ | ⋮ |

PRETREATMENT DEVICE AND PRETREATMENT INFORMATION SETTING METHOD

CROSS-REFERENCE TO RELATED APPLICATION

This application claims priority to Japanese Patent Application No. 2017-252361 filed Dec. 27, 2017. The contents of the foregoing application are hereby incorporated herein by reference.

BACKGROUND

The present disclosure relates to a pretreatment device and a pretreatment information setting method.

An inkjet textile printer is known that performs pretreatment before print processing. The inkjet textile printer is provided with a textile printing execution portion and a pretreatment portion. Before the textile printing execution portion ejects ink onto a material to be printed, the pretreatment portion performs processing to smooth out wrinkles of the material to be printed. Further, the pretreatment portion also performs other processing, such as processing to apply a coating liquid, which is used as a pretreatment agent, onto the material to be printed.

SUMMARY

There is also a case in which the pretreatment portion performs heat treatment in order to fix the pretreatment agent. It is conceivable that, in order to perform the pretreatment, an operator of the pretreatment device specifies each of a plurality of pieces of pretreatment information via an operation portion of the pretreatment device or a terminal device connected to the pretreatment device. An example of pretreatment information is an application amount per unit area of the pretreatment agent, an application range, a heat treatment time period, a heat treatment temperature and the like. However, it is troublesome for the operator to specify each of the plurality of pieces of pretreatment information each time the pretreatment is performed.

Embodiments of the broad principles derived herein provide a pretreatment device and a pretreatment information setting method that are capable of reducing troublesomeness of an operator having to specify pretreatment information.

The embodiments herein provide a pretreatment device including a pretreatment portion, a reception portion, a processor and a memory. The pretreatment portion performs a pretreatment on a recording medium. The reception portion receives recording medium information that the recording medium has. The memory stores computer-readable instructions that, when executed by the processor, perform processes including: setting, for the pretreatment portion, pretreatment information relating to the pretreatment, on the basis of the recording medium information received by the reception portion; and causing the pretreatment portion to perform the pretreatment on the basis of the set pretreatment information.

The embodiments herein also provide a pretreatment information setting method for a pretreatment device including a pretreatment portion configured to perform a pretreatment on a recording medium, a reception portion configured to receive recording medium information, and a control portion configured to control the pretreatment device. The method includes the steps of: using the control portion to set, for the pretreatment portion, pretreatment information relating to the pretreatment, on the basis of the recording medium information received by the reception portion; and using the control portion to cause the pretreatment portion to perform the pretreatment on the basis of the set pretreatment information.

BRIEF DESCRIPTION OF THE DRAWINGS

Embodiments will be described below in detail with reference to the accompanying drawings in which:

FIG. 5 is a diagram showing an example of a first table;

FIG. 6 is a diagram showing an example of a second table;

FIG. 10 is a diagram showing an example of a third table;

FIG. 11 is a diagram showing an example of a fourth table;

FIG. 13 is a diagram showing an example of a fifth table;

FIG. 14 is a diagram showing an example of a sixth table;

FIG. 16 is a diagram showing an example of a seventh table;

FIG. 19 is a diagram showing an example of an eighth table; and

DETAILED DESCRIPTION

A pretreatment device 10 of a first embodiment of the present disclosure will be explained with reference to the drawings. The pretreatment device 10 performs pretreatment before a printer 1 performs printing on a cloth, which is an example of a recording medium. Examples of the pretreatment include an application treatment of a pretreatment agent onto the cloth, and a high-temperature heat treatment to fix the pretreatment agent onto the cloth.

System Configuration

Figure 1:
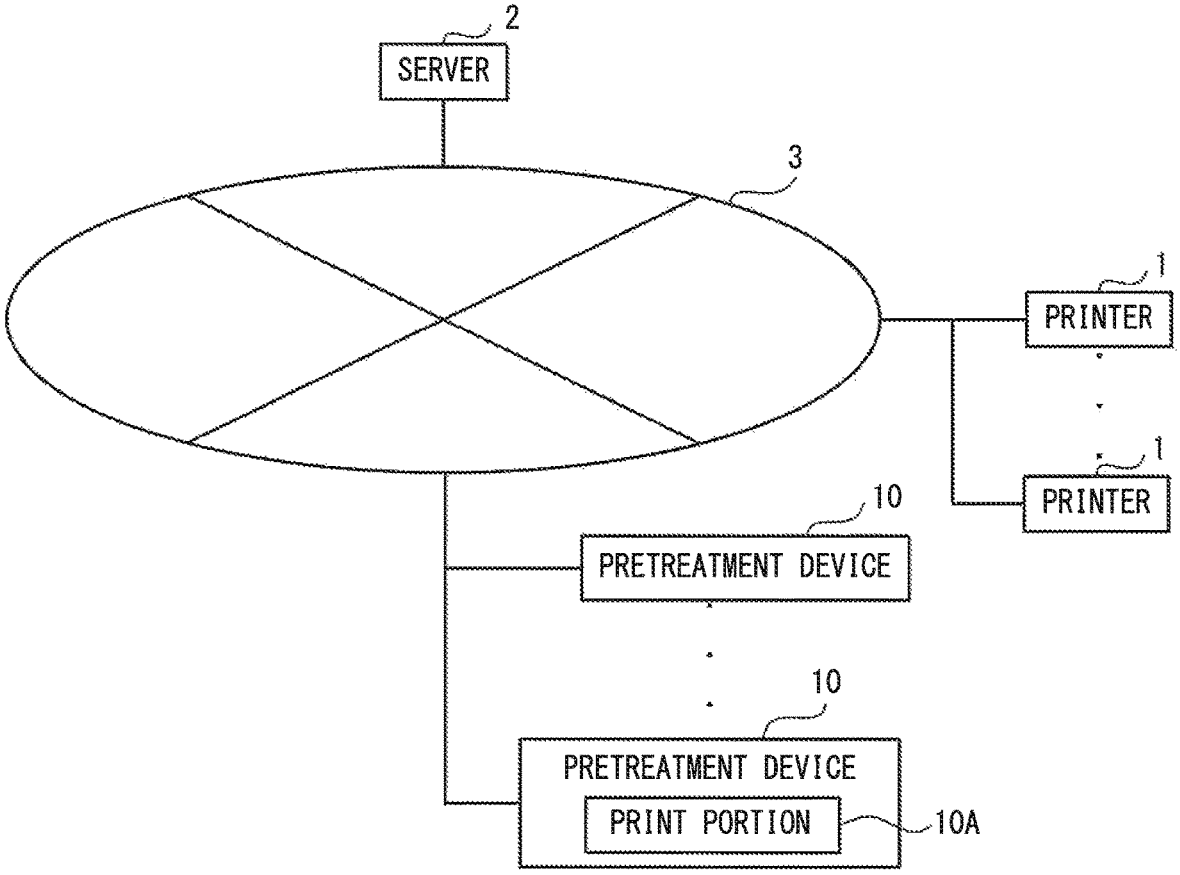
FIG. 1 is an example of a network configuration diagram of a system including a pretreatment device.

As shown in FIG. 1, one or a plurality of the pretreatment devices 10, one or a plurality of the printers 1, and a server 2 are connected to each other via a network 3. The printer 1 performs print processing on the cloth on the basis of print data. The print data is information for the printer 1 to perform printing on the cloth. Examples of the network 3 include an intranet and the Internet. Further, the one or the plurality of pretreatment devices 10, the one or the plurality of printers 1, and the server 2 need not necessarily be each connected to the network 3, and may be connected to each other via, for example, a serial cable that can be connected to a serial port, such as a USB port. Further, the connection via the network 3 and the connection via the serial cable may be mixed Pretreatment Device 10

Figure 2:
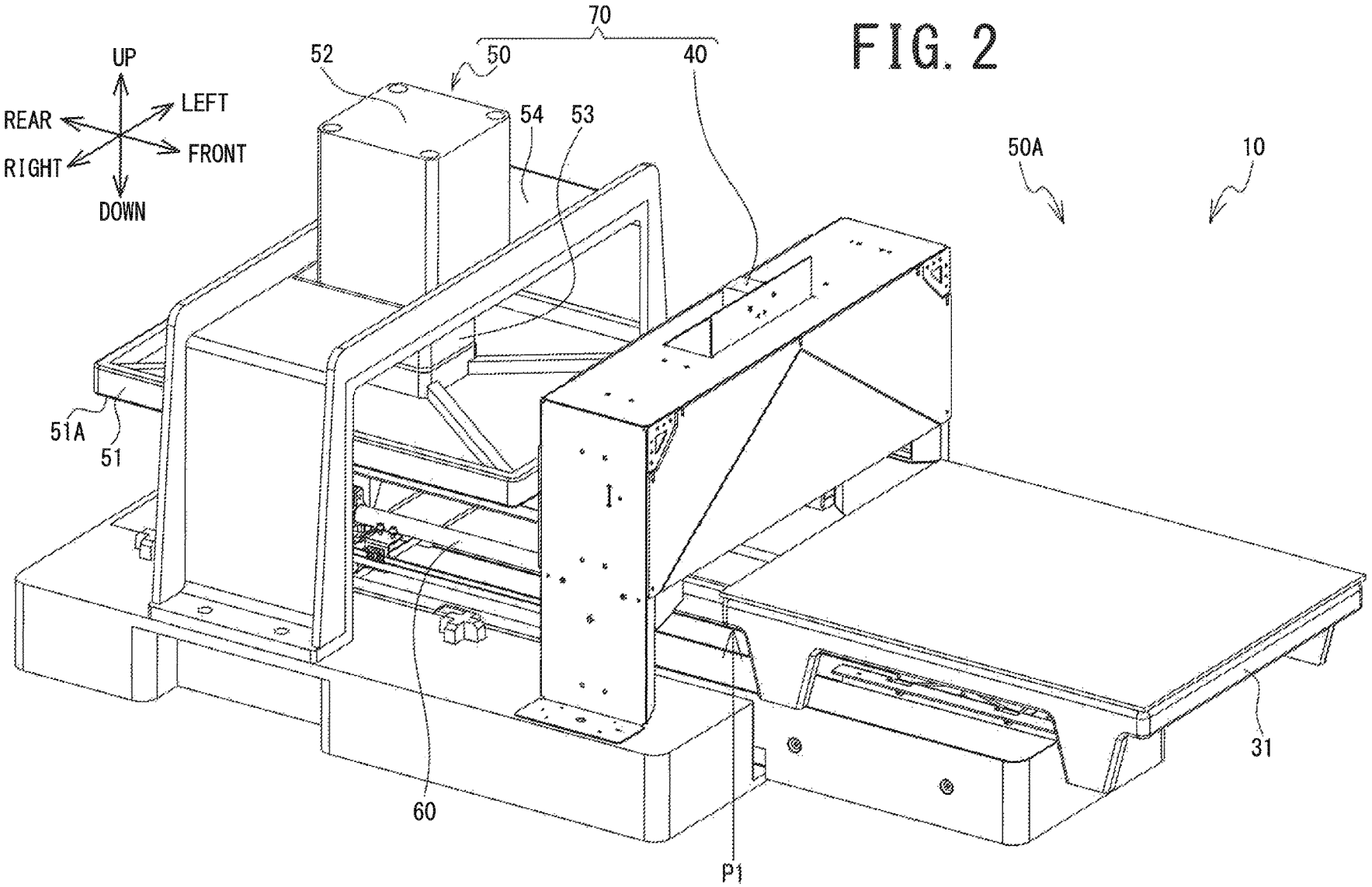
FIG. 2 is a perspective view schematically showing a configuration of the pretreatment device.

The upper side, the lower side, the lower right side, the upper left side, the lower left side and the upper right side of FIG. 2 respectively correspond to the upper side, the lower side, the front side, the rear side, the right side and the left side of the pretreatment device 10. As shown in FIG. 2, the pretreatment device 10 is provided with a platen 31, an application portion 40, a heat treatment portion 50 and the like. The cloth, which is an example of the recording medium, is placed on the platen 31. The application portion 40 applies the pretreatment agent onto the cloth. The heat treatment portion 50 pressurizes the cloth at a high temperature, for example, and dries the pretreatment agent, thus improving the fixing of the pretreatment agent to the cloth and improving image quality. Hereinafter, the application portion 40 and the heat treatment portion 50 are collectively referred to as a "pretreatment portion 70." Examples of a material of the cloth include cotton, polyester, a cotton/polyester mix, and the like. The pretreatment agent improves the color development of color inks. The pretreatment agent is, for example, an aqueous solution containing metal salt, such as $CaCl_2$.

As shown in FIG. 2, a set position P1 of the platen 31 is a position of the platen 31 when an operator places the cloth on the platen 31, and is, for example, a position when the platen 31 is moved to the frontmost side. The platen 31 has a substantially rectangular shape and the upper surface thereof is long in the front-rear direction. Further, a cylindrical coupling portion (not shown in the drawings) is provided at a central portion of the lower surface of the platen 31.

Platen Conveyance Mechanism

The pretreatment device 10 is provided with a platen conveyance mechanism (not shown in the drawings) below the platen 31. The platen conveyance mechanism conveys the platen 31 in the front-rear direction. The platen conveyance mechanism is provided with two guides 60, a belt (not shown in the drawings), a pulley (not shown in the drawings), a support portion (not shown in the drawings), a platen motor 17 (refer to FIG. 3) and the like. The two guides 60 extend rearward from a front portion of the pretreatment device 10, and are provided in parallel with each other in the left-right direction. The guides 60 are, for example, columnar metal rods. The platen 31 moves in the front-rear direction along the two guides 60. The platen motor 17 is, for example, a stepping motor.

The support portion supports the platen 31 and is coupled to the coupling portion of the platen 31. Further, the support portion has two insertion holes (not shown in the drawings) into which the two guides 60 are inserted. Thus, when the support portion is moved in the front-rear direction by the belt of the platen conveyance mechanism, the platen 31 moves in the front-rear direction.

Application Portion 40

The application portion 40 is provided with at least one spray (not shown in the drawings), a tank (not shown in the drawings) for the pretreatment agent, a flow path (not shown in the drawings) to supply the pretreatment agent in the tank to the spray, and the like. Further, nozzles (not shown in the drawings) of the spray are each connected to the flow path. When a plurality of the tanks are provided, different types of the pretreatment agent are accumulated in the tanks, respectively. A spraying surface of the spray faces the upper surface of the platen 31. When a detection portion 25 (refer to FIG. 3), which will be described in detail later, detects the movement of the platen 31 to an application position (not shown in the drawings), the spray starts to spray the pretreatment agent onto the cloth. The application position is a position at which the application portion 40 starts to apply the pretreatment agent.

Heat Treatment Portion 50

The heat treatment portion 50 is disposed such that it is separated rearward from the application portion 40. Examples of the heat treatment portion 50 include a near-infrared ray heater, an air blowing device that blows high-temperature air, a heat press device, a heat roller and the like. Hereinafter, an explanation will be made assuming that the heat treatment portion 50 is the heat press device. The heat treatment portion 50 is provided with a heat press portion 51, a press surface drive mechanism 52, a coupling portion 53, a press support portion 54 and the like. The press surface drive mechanism 52 is provided with a pulley (not shown in the drawings), a press motor 19 (refer to FIG. 3) and the like. The heat press portion 51 is formed in a substantially rectangular shape that is long in the front-rear direction. The lower surface of the heat press portion 51 functions as a press surface 51A.

The heat press portion 51 is internally provided with a heat generation mechanism (not shown in the drawings) that generates heat at a specified temperature, and can be moved up and down by the press surface drive mechanism 52. When the detection portion 25 detects the movement of the platen 31 to a heat treatment position (not shown in the drawings), the press portion 51 is lowered by the press surface drive mechanism 52, and the press surface 51A starts a heat press operation with respect to the cloth. Hereinafter, the position at which the heat treatment portion 50 starts a downward press operation is referred to as the "heat treatment position."

For example, when the platen 31 is positioned at the heat treatment position, the press surface 51A is larger than the upper surface of the platen 31 in four directions (the front-rear and left-right directions). In this case, the pretreatment device 10 can heat press a region of the cloth onto which the pretreatment agent has been applied, at one time.

Electrical Configuration of Pretreatment Device 10

Figure 3:
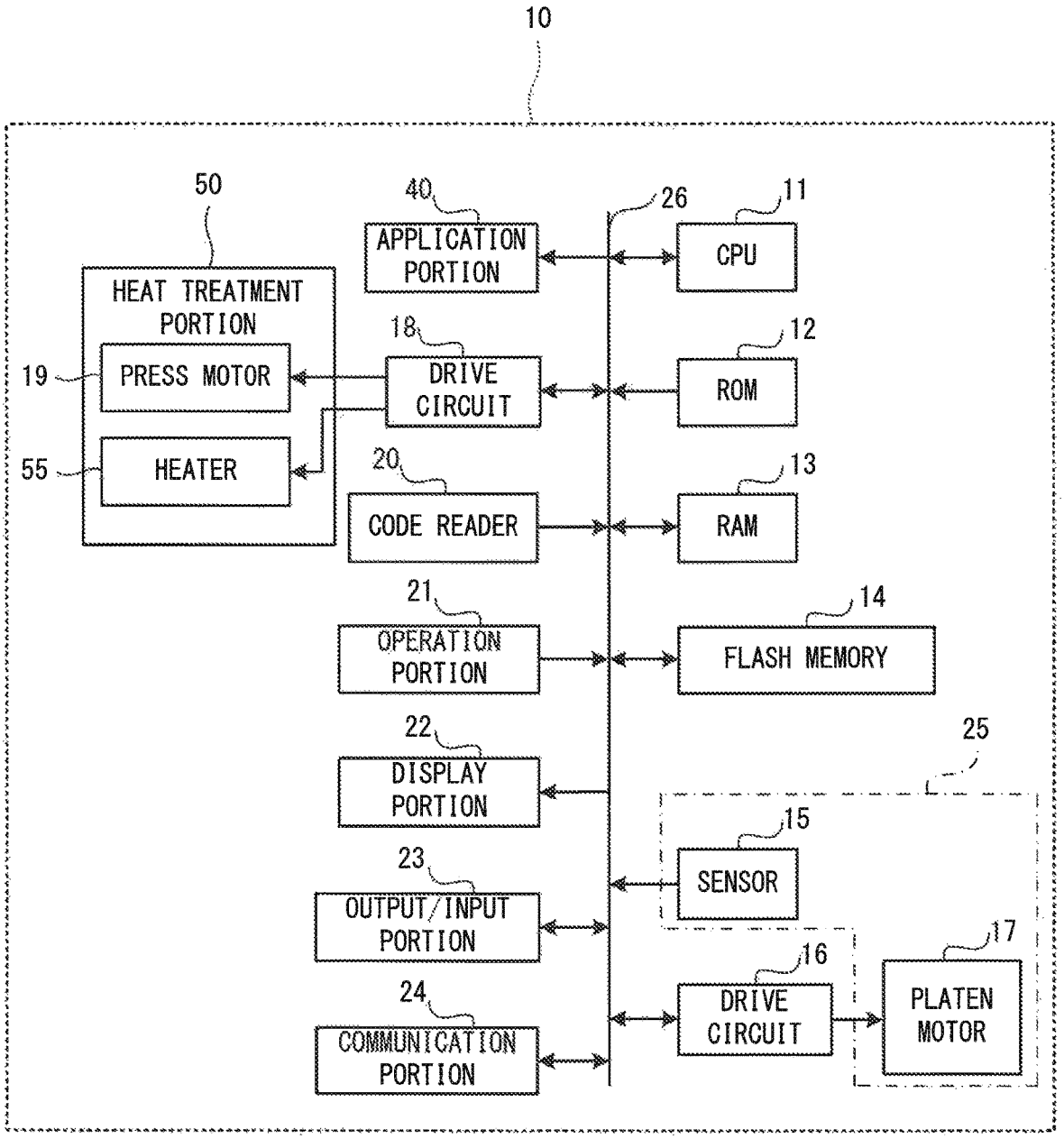
FIG. 3 is a block diagram schematically showing an electrical configuration of the pretreatment device.

As shown in FIG. 3, the pretreatment device 10 is provided with a CPU 11, a ROM 12, a RAM 13, a flash memory 14, a sensor 15, drive circuits 16 and 18, a code reader 20, an operation portion 21, a display portion 22, an output/input portion 23, a communication portion 24, the application portion 40, the heat treatment portion 50 and the like. The heat treatment portion 50 is provided with the press motor 19 and a heater 55. Each configuration of the pretreatment device 10 is connected to each other via a bus 26. The CPU 11 controls the pretreatment device 10, reads out various programs from the ROM 12, and performs various types of processing using the RAM 13 as a working memory. For example, the CPU 11 reads out a main processing program from the ROM 12, and performs main processing that will be described in detail later.

The flash memory 14 stores various tables, parameters and the like. The flash memory 14 stores tables (correspondence information) including a first table 81, a second table 82 and the like, which will be described in detail later. The tables are an example of the correspondence information. Although, in the present embodiment, an explanation will be made taking the tables as an example, the correspondence information may be in any form. Further, the flash memory 14 stores each of pieces of default information of pretreatment information that will be described in detail later. Further, the flash memory 14 associates and stores the number of steps of the platen motor 17 and the heat treatment position.

Figure 7:
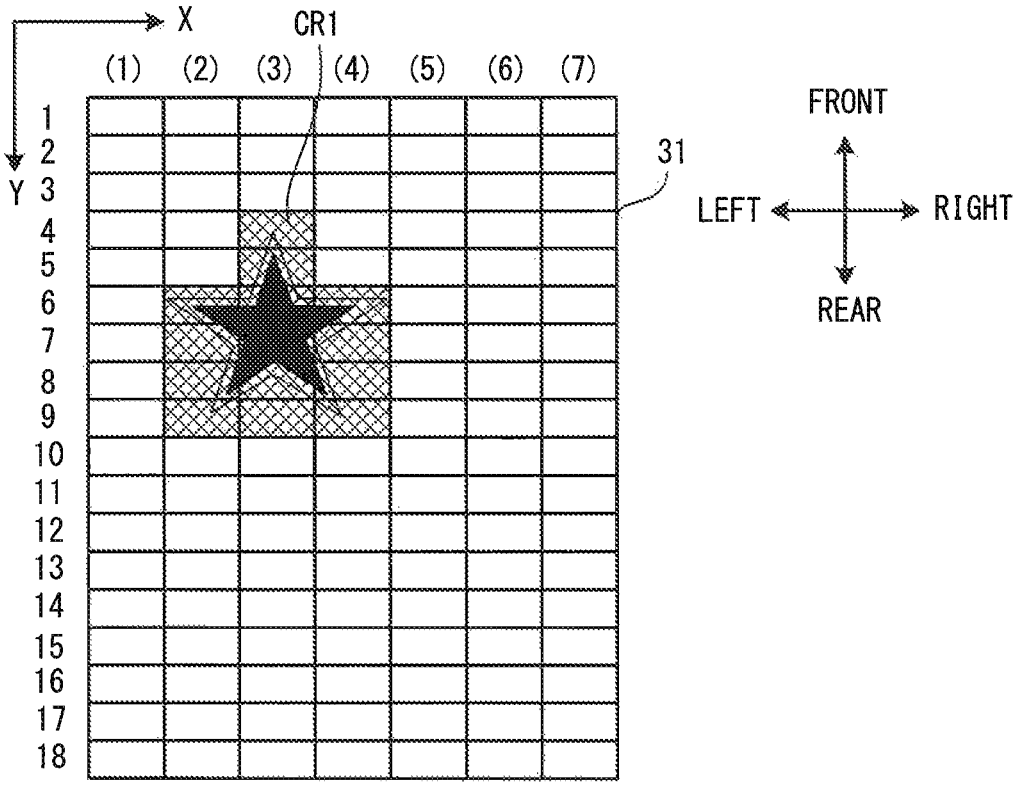
FIG. 7 is a diagram showing an application range in a specific example.
Figure 8:
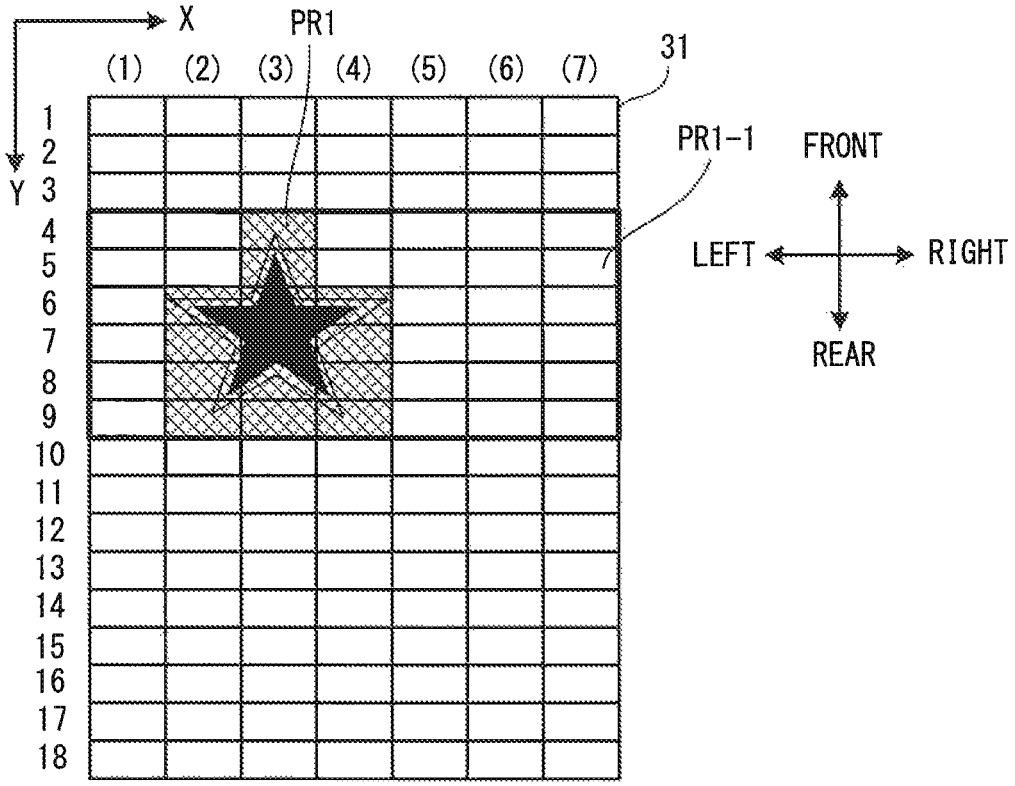
FIG. 8 is a diagram showing a heat treatment range in the specific example.

The association between the number of steps of the platen motor 17 and the application position or the heat treatment position will be explained briefly. As shown in FIG. 7 and FIG. 8 to be explained later, XY coordinates are set for the platen 31. The Y axis of the platen 31 is parallel to the front-rear direction, and the X axis is parallel to the left-right direction. The origin of the XY coordinates is the left front end of the platen 31. The plus direction of the Y axis is the rearward direction, and the plus direction of the X axis is the rightward direction. The flash memory 14 associates and stores the application position at the Y coordinate of the platen 31 and the number of steps of the platen motor 17.

In the examples shown in FIG. 7 and FIG. 8, the platen 31 is divided into 7×18 regions. The flash memory 14 associates and stores the regions and the XY coordinates of at least the left front end of each of the regions. The number of divisions "7" in the X axis direction corresponds to the number of sprays provided in the application portion 40. In the present embodiment, the application portion 40 is provided with seven sprays. Although the number of divisions in the Y axis direction can be any number, as the number of divisions increases, an application range of the pretreatment agent can be set more finely. As a result, it is possible to avoid waste of the pretreatment agent, and it is also possible to shorten a time period required for the application.

The sensor 15 is a position detection sensor, such as a transmission sensor, and is disposed at a position where the set position P1 of the platen 31 can be detected. As long as the sensor 15 can detect the set position P1, a position detection sensor of one of a mechanical type and an optical type can be used.

The drive circuit 16 is connected to the platen motor 17, and drives the platen motor 17 under the control of the CPU 11. The drive circuit 18 is connected to the press motor 19 and the heater 55, and drives the press motor 19 and the heater 55 under the control of the CPU 11. The heater 55 heats the heat press portion 51. In the present embodiment, the detection portion 25 is formed by a combination of the sensor 15 and the platen motor 17. In the present embodiment, as described above, the platen motor 17 is the stepping motor. Therefore, the flash memory 14 associates and stores the step number of the platen motor 17 and the heat treatment position and the application position. Thus, on the basis of the number of steps from the set position P1, the detection portion 25 can detect the application position and the heat treatment position. Further, the detection portion 25 can detect an application end position of the application range.

The code reader 20 reads information of a one-dimensional code, such as a bar code attached to the recording medium such as a cloth, a two-dimensional code, such as a QR code, or a three-dimensional code, and inputs the read information into the CPU 11. The information of these codes is recording medium information that is information relating to the recording medium, such as a cloth. Examples of the recording medium information include the pretreatment information, an identifier and media information. Each of the pretreatment information, the identifier and the media information will be described later. In the present embodiment, the recording medium information includes at least part of the pretreatment information. Note that the information of these codes may be printed on a part of the recording medium, or may be printed on paper or the like and associated with the recording medium using a clip, a tape, placement or the like. Therefore, these forms are referred to as "the recording medium has the recording medium information."

The operation portion 21 is provided with an operation panel and the like. The operation panel is provided with buttons etc., for example. Therefore, the operator can give a desired command to the pretreatment device 10 via the operation portion 21. Further, when the code attached to the recording medium, such as a cloth, is a bar code, the operator may input a numeric string written along with the bar code via the operation portion 21. The display portion 22 is formed by a known display device or the like. The display portion 22 may be provided with a touch panel and may function as the operation portion 21. The output/input portion 23 is provided with a secure digital (SD) memory card slot, a USB port and the like.

The communication portion 24 has at least one of a wireless module (not shown in the drawings) and a wired module (not shown in the drawings), and can be connected to the printer 1 and the server 2 via the network 3. The pretreatment device 10 may be connected to the printer 1 and the server 2 via the network 3 by the wireless module connectable to the USB port, in place of the communication portion 24.

Electrical Configuration of Server 2

Figure 4:
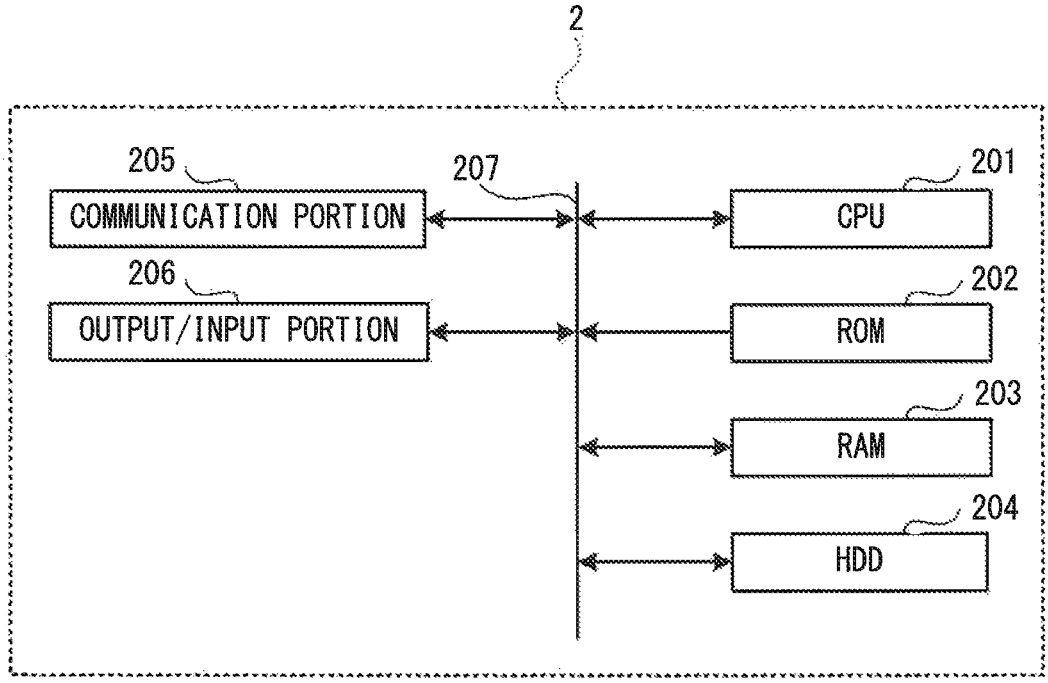
FIG. 4 is a block diagram schematically showing an electrical configuration of a server.

As shown in FIG. 4, the server 2 is provided with a CPU 201, a ROM 202, a RAM 203, an HDD 204, a communication portion 205 and an output/input portion 206 and the like. Each configuration of the server 2 is connected to each other via a bus 207. The CPU 201 performs overall control of the server 2, reads out various programs from the HDD 204, and performs various types of processing using the RAM 203 as a working memory. The HDD 204 stores the various programs and various types of information.

The communication portion 205 has at least one of a wireless module (not shown in the drawings) and a wired module (not shown in the drawings), and can be connected to the printer 1 and the pretreatment device 10 via the network 3. The server 2 may be connected to the printer 1 and the pretreatment device 10 via the network 3 by the wireless module connectable to a USB port, in place of the communication portion 205. The output/input portion 206 is provided with the USB port and a serial port of another standard.

First Table 81

As shown in FIG. 5, the first table 81 is a table listing the pretreatment information. The first table 81 is stored in the flash memory 14 of the pretreatment device 10. The pretreatment information includes application treatment information relating to the application treatment, and heat treatment information relating to the heat treatment. In the example shown in FIG. 5, the application treatment information includes an application amount per unit area (mg/

$cm^2$), the application range, and a type of the pretreatment agent. The application amount per unit area ($mg/cm^2$) is information indicating the application amount per unit area ($mg/cm^2$) of the pretreatment agent. The application range is information indicating the range over which the pretreatment agent is applied. The type of the pretreatment agent is information indicating the type of the pretreatment agent.

In the example shown in FIG. 5, the heat treatment information includes a heat treatment pressure ($N/cm^2$), a heat treatment time period (sec), a heat treatment temperature (° C.), a heat treatment range, and a number of times of the heat treatment. When the heat treatment portion 50 is a heat press portion, a heat roller or the like that applies a pressure to the cloth that is a heat treatment target, the heat treatment pressure ($N/cm^2$) is a value of the pressure applied to the cloth at the time of the heat treatment. Therefore, when the heat treatment portion 50 is a near-infrared ray heater, an air blowing device or the like that does not come into contact with the cloth, the heat treatment pressure is set to null (–). The heat treatment time period (sec) is a time period during which the heat treatment is performed. The heat treatment temperature (° C.) is a temperature of the heat treatment. The heat treatment range is a range over which the heat treatment is performed. The number of times of the heat treatment is the number of times that the heat treatment of the set heat treatment time period (sec) is repeated.

Second Table 82

As shown in FIG. 6, the second table 82 is a table in which an application section in the left-right direction (the X axis direction) of an application region is associated with each of the sprays. The second table 82 shown in FIG. 6 is an example of a case in which the number of sprays is seven, and the left end of the platen 31 is "0" on the X axis. For example, the application section of a spray (3) is [b, c]. In other words, the spray (3) can spray the pretreatment agent onto the application section [b, c].

FIG. 7 is a diagram showing an application range CR1 in a specific example. In the example shown in FIG. 7, the application range CR1 is a hatched region. More specifically, the application range CR1 is a region formed by a region [(3), 4-5] and a region [(2)-(4), 6-9]. FIG. 8 is a diagram showing heat treatment ranges PR1 and PR1-1 in the specific example. In the example shown in FIG. 8, when the heat treatment portion 50 is a near-infrared ray device or the like and is configured to be capable of performing the heat treatment on each of the regions obtained by dividing the platen 31 (divided into 7×18 regions in the examples shown in FIG. 7 and FIG. 8), the heat treatment portion 50 can perform the heat treatment on each of the divided regions under the control of the CPU 11. In this case, the heat treatment portion 50 performs the heat treatment taking the hatched region as the heat treatment range PR1. More specifically, in this case, the application range CR1 and the heat treatment range PR1 are the same range.

On the other hand, when the pretreatment device 10 is configured such that the heat treatment portion 50 is a heat press device, an air blowing device, a heat roller or the like and cannot perform the heat treatment, under the control of the CPU 11, on each of the regions obtained by dividing the platen 31 (divided into 7×18 regions in the examples shown in FIG. 7 and FIG. 8), the heat treatment portion 50 performs the heat treatment taking, for example, a region [(1)-(7), 4-9] surrounded by a thick line frame as the heat treatment range PR1-1. More specifically, the heat treatment range PR1-1 has a shape that is dependent on the configuration of the heat treatment portion 50, and, for example, if the press surface 51A shown in FIG. 2 is the same shape as the platen 31, the heat treatment range PR1-1 has the same shape as the platen 31.

First Main Processing

A flow of first main processing will be explained with reference to FIG. 9. The first main processing is performed when triggered by turning on a power source of the pretreatment device 10. The CPU 11 reads out the main processing program from the ROM 12, and performs the first main processing using the RAM 13 as a working memory. In the first embodiment, as described above, the recording medium information includes at least part of the pretreatment information.

First, the CPU 11 determines whether the recording medium information has been received (step S1). For example, when information obtained by coding the recording medium information has been input from the code reader 20, or when the numeric string attached to the code has been input from the operation portion 21, the CPU 11 determines that the recording medium information has been received. When the information obtained by coding the recording medium information has not been input from the code reader 20, or when the numeric string attached to the code has not been input from the operation portion 21, the CPU 11 determines that the recording medium information has not been received. When it is determined that the recording medium information has not been received (no at step S1), the CPU 11 returns the processing to step S1 and repeats the processing at step S1.

When it is determined that the recording medium information has been received (yes at step S1), the CPU 11 determines whether all the pretreatment information is contained in the received recording medium information (step S1A). All the pretreatment information is, for example, the information of the application amount per unit area ($mg/cm^2$), the application range, the type of the pretreatment agent, the heat treatment pressure ($N/cm^2$), the heat treatment time period (sec), the heat treatment temperature (° C.), the heat treatment range, and the number of times of the heat treatment. When it is determined that all the pretreatment information is contained (yes at step S1A), the CPU 11 advances the processing to step S9.

When it is determined that all the pretreatment information is not contained (no at step S1A), the CPU 11 cross-checks the pretreatment information included in the recording medium information with the list of the pretreatment information in the first table 81, and identifies the pretreatment information that completely matches the pretreatment information included in the recording medium information (step S1B). For example, when the pretreatment information included in the recording medium information is only the application amount per unit area ($mg/cm^2$), the application range and the type of the pretreatment agent, the CPU 11 identifies, from the list of the pretreatment information in the first table 81, the pretreatment information that matches all of the application amount per unit area ($mg/cm^2$), the application range and the type of the pretreatment agent. At this time, when the CPU 11 cannot identify the pretreatment information that completely matches the pretreatment information included in the recording medium information, the CPU 11 identifies the lacking pretreatment information from default pretreatment information stored in the flash memory 14. Further, when a plurality of pieces of the pretreatment information that completely match the pretreatment information included in the recording medium information are identified, the CPU 11 identifies any one of the plurality of pieces of pretreatment information.

The CPU 11 acquires, from the identified pretreatment information, the pretreatment information that contains all the information for the pretreatment (step S3). The CPU 11 sets the pretreatment information that contains all the information, for the application portion 40 and the heat treatment portion 50 (step S9). For example, the CPU 11 stores the application treatment information of the acquired pretreatment information in an area of the RAM 13 that stores control information of the application portion 40, and stores the heat treatment information in an area of the RAM 13 that stores control information of the heat treatment portion 50. At this time, for the application portion 40, the CPU 11 performs setting to stop the spray(s) that do not have the application section within the application range included in the pretreatment information. For example, among pieces of spray identification information that can uniquely identify each of the sprays, the CPU 11 stores only the spray identification information of the spray(s) to be operated, in the area of the RAM 13 that stores the control information of the application portion 40.

The CPU 11 determines whether a start button has been selected (step S11). For example, the CPU 11 determines whether information indicating the selection of the start button has been input from the operation portion 21, and thus determines whether the start button has been selected. When it is determined that the start button has not been selected (no at step S11), the CPU 11 repeats the processing at step S11. When it is determined that the start button has been selected (yes at step S11), the CPU 11 controls the drive circuit 16 and causes the platen motor 17 to operate. In this way, the CPU 11 causes the platen 31 to be conveyed and controls the application portion 40 and the heat treatment portion 50, thus starting the pretreatment (step S13). For example, the CPU 11 reads out the control information of each of the application portion 40 and the heat treatment portion 50 from the RAM 13, and starts the pretreatment on the basis of the read out control information. At this time, when the application amount per unit area (mg/cm$^2$) is "0," the application of the pretreatment agent is not performed by the application portion 40. Further, when the heat treatment time period (sec) is "0," the heat treatment is not performed by the heat treatment portion 50.

The CPU 11 determines whether the pretreatment is completed (step S15). For example, the CPU 11 determines whether the heat treatment of the set heat treatment time period (sec) has been performed the set number of times, and thus determines whether the pretreatment is completed. When it is determined that the pretreatment is not completed (no at step S15), the CPU 11 repeats the processing at step S15.

When it is determined that the pretreatment is completed (yes at step S15), the CPU 11 controls the drive circuit 16 and causes the platen motor 17 to operate. Thus, the CPU 11 causes the platen 31 to move to the set position P1 (step S16), and returns the processing to step S1.

After the pretreatment has been performed, or after the pretreatment has not been performed because the application amount per unit area (mg/cm$^2$) is "0" and the heat treatment time period (sec) is "0," the print processing is performed on the recording medium by the printer 1 that prints the recording medium of a processing target.

Main Operations and Effects of First Embodiment

The pretreatment device 10 of the above-described first embodiment receives the recording medium information that the recording medium has, and sets the pretreatment information for the pretreatment portion 70 on the basis of the received recording medium information, and causes the pretreatment portion 70 to perform the pretreatment on the basis of the set pretreatment information. Therefore, by receiving the recording medium information that the recording medium has, the pretreatment device 10 causes the pretreatment portion 70 to perform the pretreatment. It is thus possible to reduce the troublesomeness of the operator having to specify the pretreatment information.

Further, the pretreatment device 10 of the above-described first embodiment receives the recording medium information that includes at least part of the pretreatment information. When all the pretreatment information is contained in the received recording medium information, the pretreatment information included in the recording medium information is set for the pretreatment portion 70. In this way, the pretreatment device 10 receives the recording medium information that the recording medium has, and causes the pretreatment portion 70 to perform the pretreatment. It is thus possible to reduce the troublesomeness of the operator having to specify the pretreatment information.

Further, when only part of the pretreatment information is included in the received recording medium information, the pretreatment device 10 cross-checks the pretreatment information included in the received recording medium information with the list of the pretreatment information in the first table 81, and acquires the pretreatment information that contains all the information for the pretreatment from the first table 81, on the basis of the pretreatment information that completely matches the pretreatment information included in the recording medium information. The pretreatment device 10 sets the acquired pretreatment information for the pretreatment portion 70. In this way, the pretreatment device 10 receives the recording medium information that the recording medium has, and causes the pretreatment portion 70 to perform the pretreatment. It is thus possible to reduce the troublesomeness of the operator having to specify the pretreatment information. In other words, the more the pretreatment information included in the recording medium information increases, the more it is possible to reduce the troublesomeness of the operator having to specify the pretreatment information.

Further, when, as a result of the cross-check, the pretreatment information that completely matches the pretreatment information included in the recording medium information is not present in the list of the pretreatment information of the first table 81, the pretreatment device 10 acquires the lacking pretreatment information from the default pretreatment information stored in the flash memory 14. The pretreatment device 10 sets the pretreatment information that contains all the information, for the pretreatment portion 70. In this way, the pretreatment device 10 receives the recording medium information that the recording medium has, and causes the pretreatment portion 70 to perform the pretreatment. It is thus possible to reduce the troublesomeness of the operator having to specify the pretreatment information.

The pretreatment device 10 of the above-described first embodiment sets, for the application portion 40, the application treatment information in the acquired pretreatment information, and causes the application portion 40 to perform the application of the pretreatment agent on the basis of the set application treatment information. In this way, the pretreatment device 10 receives the recording medium information that the recording medium has, and causes the application portion 40 to perform the application of the pretreatment agent. It is thus possible to reduce the troublesomeness of the operator having to specify the application treatment information.

The pretreatment device 10 of the above-described first embodiment sets, for the heat treatment portion 50, the heat treatment information in the acquired pretreatment information, and causes the heat treatment portion 50 to perform the heat treatment on the basis of the set heat treatment information. In this way, the pretreatment device 10 receives the recording medium information that the recording medium has, and causes the heat treatment portion 50 to perform the heat treatment. It is thus possible to reduce the troublesomeness of the operator having to specify the heat treatment information.

Second Embodiment

The configuration of the network 3 and the configurations of the pretreatment device 10 and the server 2 of a second embodiment are substantially the same as those of the first embodiment. Therefore, different portions will be explained and an explanation of portions that are the same as those of the first embodiment will be omitted here. In the second embodiment, the ROM 12 stores a second main processing program. Further, the flash memory 14 stores the second table 82, and a third table 83 and a fourth table 84 that will be described in detail later. In the second embodiment, the recording medium information includes an identifier.

Third Table 83

As shown in FIG. 10, the third table 83 is a table in which the identifiers and the pretreatment information are associated with each other. The identifier is information that can uniquely identify the cloth, which is the recording medium. Therefore, in the third table 83, the pretreatment information is associated with each of the cloths. Further, since the pretreatment information is associated with each of the cloths and the identifier is the information that can uniquely identify the cloth, the identifier is also information that can uniquely identify the pretreatment information.

Fourth Table 84

As shown in FIG. 11, the fourth table 84 is an example of a table indicating the pretreatment information. Each of the information items indicating the pretreatment information of the fourth table 84 is associated with the pretreatment information of the above-described third table 83. Therefore, the fourth table 84 shown in FIG. 11 is an example of the pretreatment information that is associated with each of the identifiers of the third table 83. Since the pretreatment information, such as the application amount per unit area ($mg/cm^2$) of the pretreatment agent, is explained in the first embodiment with reference to FIG. 5, an explanation thereof is omitted here.

Second Main Processing

A flow of second main processing will be explained with reference to FIG. 12. The second main processing is performed when triggered by turning on the power source of the pretreatment device 10. The CPU 11 reads out the second main processing program from the ROM 12, and performs the second main processing using the RAM 13 as a working memory. In the second embodiment, as described above, the recording medium information includes the identifier.

First, the CPU 11 determines whether the recording medium information has been received (step S1). The processing at step S1 of the second main processing is the same as the processing at step S1 of the first main processing shown in FIG. 9, and an explanation thereof is thus omitted here. When it is determined that the recording medium information has not been received (no at step S1), the CPU 11 returns the processing to step S1 and repeats the processing at step S1.

When it is determined that the recording medium information has been received (yes at step S1), the CPU 11 cross-checks the third table 83 and the identifier included in the received recording medium information, and identifies the pretreatment information (step S2). For example, the CPU 11 cross-checks the identifiers of the third table 83 with the identifier included in the recording medium information, and identifies the pretreatment information corresponding to the identifier included in the recording medium information. For example, when the identifier included in the recording medium information is "ID3," the CPU 11 identifies pretreatment information 3. The CPU 11 acquires the identified pretreatment information (step S3).

Figure 12:
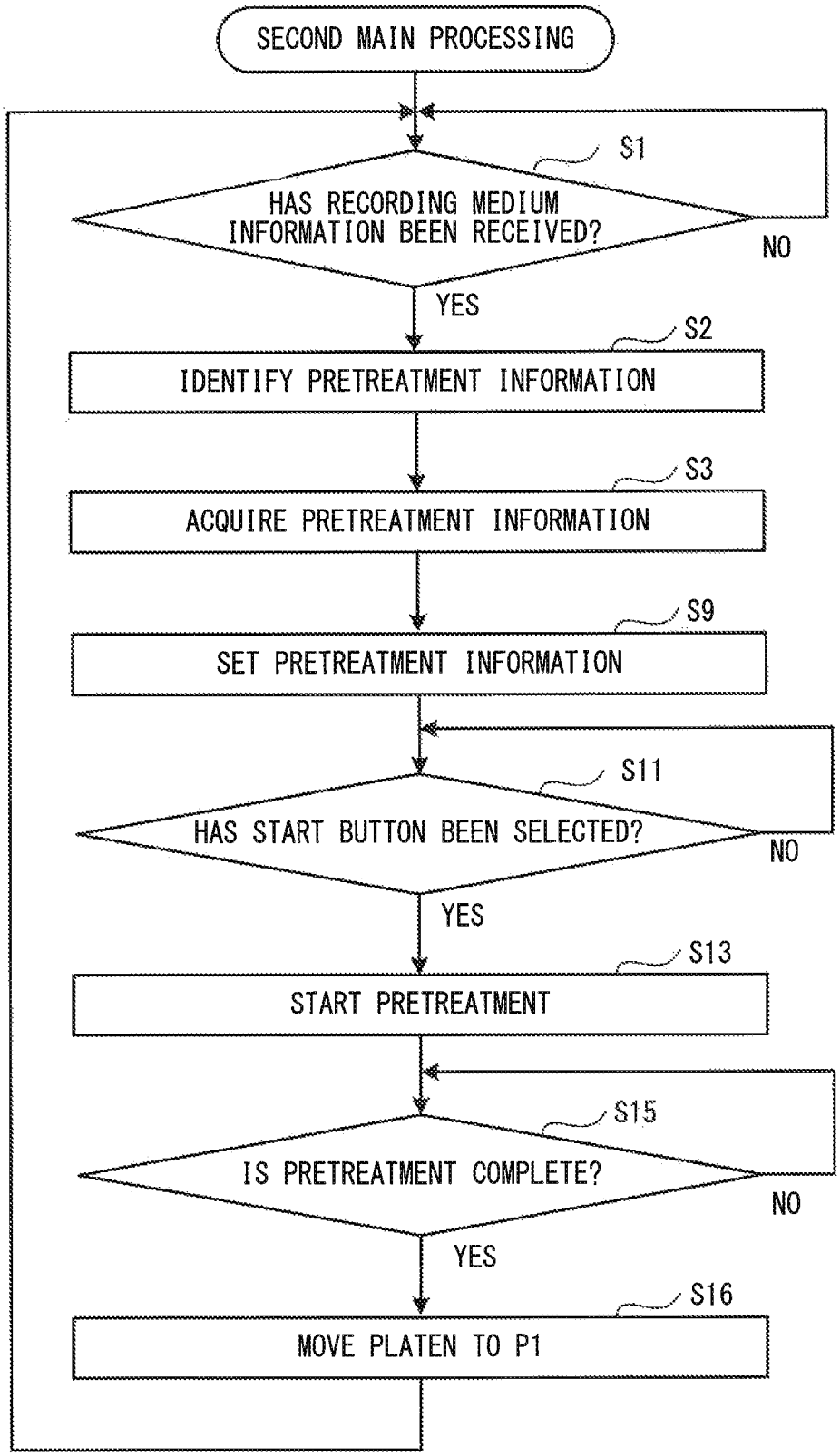
FIG. 12 is a flowchart showing a flow of second main processing.

Then, the CPU 11 performs processing from step S9 to step S16 of the second main processing shown in FIG. 12. The processing from step S9 to step S16 of the second main processing is the same as the processing from step S9 to step S16 of the first main processing shown in FIG. 9, and an explanation thereof is thus omitted here.

Main Operations and Effects of Second Embodiment

The pretreatment device 10 of the above-described second embodiment receives the recording medium information including the identifier, refers to the third table 83 stored in the flash memory 14, and identifies the pretreatment information corresponding to the identifier included in the received recording medium information. The pretreatment device 10 acquires the identified pretreatment information and sets the acquired pretreatment information for the pretreatment portion 70. In this way, the pretreatment device 10 receives the recording medium information including the identifier that the recording medium has, and causes the pretreatment portion 70 to perform the pretreatment. It is thus possible to reduce the troublesomeness of the operator having to specify the pretreatment information.

Third Embodiment

The configuration of the network 3 and the configurations of the pretreatment device 10 and the server 2 of a third embodiment are substantially the same as those of the first embodiment. Therefore, different portions will be explained and an explanation of portions that are the same as those of the first embodiment will be omitted here. In the third embodiment, the ROM 12 stores a third main processing program to be described later. Further, the flash memory 14 stores the second table 82, the fourth table 84, and a fifth table 85 and a sixth table 86 that will be described in detail later. In the third embodiment, the recording medium information includes the media information. The media information is information relating to the recording medium of a pretreatment target. The media information will be further described later.

Fifth Table 85

As shown in FIG. 13, the fifth table 85 is a table in which the media information and the pretreatment information are associated with each other. The media information is, for example, information of a manufacturer, a brand, a model number, a fabric thickness, a material, a knit/weave, a color and a lot. The manufacturer, the brand, the model number and the lot are also referred to as manufacturing information. Further, the fabric thickness, the material, the knit/weave and the color are also referred to as material information. The media information includes at least one of the manufacturing information and the material information.

The manufacturer is information of a manufacturing source of a finished product in which the printing has been performed on the recording medium. Hereinafter, the finished product is referred to as a product. The brand is information of the brand developed by the manufacturer. The model number is information of a management number that is assigned to each model of the product. The fabric thickness is information of a weight of the fabric per unit area. The material is information of the material of the fabric of the recording medium, such as cotton, polyester, a cotton/polyester mix, and the like. The knit/weave is information of a knitting method or a weaving method of the fabric. The color is information of a color of the recording medium. The lot is information of a management number of a manufacturing unit of the product that is used for production management.

Sixth Table 86

As shown in FIG. 14, the sixth table 86 is a table in which specified colors are set. The specified colors are colors for which the pretreatment is not performed, and are, for example, colors for which the image quality is hardly improved even if the pretreatment agent is applied to the cloth and the fixing of the pretreatment agent is improved by the heat treatment. The specified colors are colors set in the sixth table 86, and colors whose brightness is equal to or more than a brightness threshold value BN set in the sixth table 86. The sixth table 86 can be set via the operation portion 21, for example.

Third Main Processing

A flow of third main processing will be explained with reference to FIG. 15. The third main processing is performed by a trigger, i.e., by turning on the power source of the pretreatment device 10. The CPU 11 reads out the third main processing program from the ROM 12, and performs the third main processing using the RAM 13 as a working memory. In the third embodiment, as described above, the recording medium information includes the media information.

First, the CPU 11 determines whether the recording medium information has been received (step S1). The processing at step S1 of the third main processing is the same as the processing at step S1 of the first main processing shown in FIG. 9, and an explanation thereof is thus omitted here. When it is determined that the recording medium information has not been received (no at step S1), the CPU 11 returns the processing to step S1 and repeats the processing at step S1.

When it is determined that the recording medium information has been received (yes at step S1), the CPU 11 determines whether it is the first-time reception of the recording medium information after the power source of the pretreatment device 10 has been turned on (step S2H). For example, the CPU 11 determines whether it is the recording medium information input from the code reader 20 for the first time after the power source has been turned on, and thereby determines whether it is the first-time reception of the recording medium information after the power source has been turned on. Whether it is the recording medium information input for the first time is determined on the basis of whether the recording medium information already recorded in the RAM 13 is present. When the CPU 11 determines that it is the first-time reception of the recording medium information (yes at step S2H), the CPU 11 advances the processing to step S3.

When the CPU 11 determines that it is not the first-time reception of the recording medium information (no at step S2H), the CPU 11 performs comparison with the media information received a previous time that is stored in the flash memory 14, and determines whether only the lot has changed in the media information received this time (step S2C). For example, the CPU 11 compares the media information received the previous time and the media information received this time, and determines whether only the lot has changed, by determining whether a difference between the two pieces of media information is only the lot. When it is determined that some item other than the lot has also changed or the two pieces of media information are the same as each other (no at step S2C), the CPU 11 advances the processing to step S3. When it is determined that only the lot has changed (yes at step S2C), the CPU 11 determines whether the pretreatment information has changed (step S2D). For example, the CPU 11 cross-checks the received media information and the fifth table 85, and identifies the pretreatment information corresponding to the media information. The CPU 11 compares the identified pretreatment information and the pretreatment information identified the previous time, and thus determines whether the pretreatment information has changed.

When it is determined that the pretreatment information has not changed (no at step S2D), the CPU 11 advances the processing to step S5. When it is determined that the pretreatment information has changed (yes at step S2D), the CPU 11 issues a warning about the change in the pretreatment information (step S2E). At this time, for example, the CPU 11 controls the display portion 22 and causes the display portion 22 to display the change in the pretreatment information. Next, the CPU 11 acquires the pretreatment information (step S3). For example, when it is determined, in the processing at step S2C, that some item other than the lot has also changed (no at step S2C), the CPU 11 cross-checks the received media information and the fifth table 85, identifies the pretreatment information corresponding to the media information, and acquires the identified pretreatment information. Further, when it is determined, in the processing at step S2D, that the pretreatment information has changed (yes at step S2D), the CPU 11 acquires the pretreatment information identified by the processing at step S2D.

On the basis of the media information, the CPU 11 determines whether the application of the pretreatment agent is necessary (step S5). For example, the CPU 11 refers to the sixth table 86, and determines whether the information of the color included in the material information included in the media information does not correspond to the specified color set in the sixth table 86. At this time, when the media information includes only the manufacturing information, the CPU 11 performs the above-described determination after identifying the material information on the basis of the manufacturing information. When it is determined that the information of the color does not correspond to the specified color, the CPU 11 determines that the application of the pretreatment agent is necessary (yes at step S5). On the other hand, when it is determined that the information of the color corresponds to the specified color, the CPU 11 determines that the application of the pretreatment agent is not necessary (no at step S5).

When it is determined that the application of the pretreatment agent is not necessary (no at step S5), the CPU 11 determines whether the heat treatment is necessary (step S7). For example, when the received media information includes a heat treatment command, which is a command to perform the heat treatment, the CPU 11 determines that the heat treatment is necessary (yes at step S7). On the other hand, when the received media information does not include the heat treatment command, the CPU 11 determines that the heat treatment is not necessary (no at step S7). When it is determined that the heat treatment is necessary (yes at step S7), the CPU 11 advances the processing to step S9.

When it is determined that the application of the pretreatment agent is necessary (yes at step S5), the CPU 11 sets the acquired pretreatment information for the pretreatment portion 70 (step S9). For example, the CPU 11 stores the application treatment information of the acquired pretreatment information in the area of the RAM 13 that stores the control information of the application portion 40, and stores the heat treatment information in the area of the RAM 13 that stores the control information of the heat treatment portion 50. Therefore, when it is determined that pretreatment is to be performed (yes at step S5), the CPU 11 performs pretreatment (S13). At this time, when only the heat treatment is necessary, the CPU 11 sets, for the heat treatment portion 50, the heat treatment information in the acquired pretreatment information. In this case, the CPU 11 stores only the heat treatment information in the acquired pretreatment information in the area of the RAM 13 that stores the control information of the heat treatment portion 50. Further, for the application portion 40, the CPU 11 performs the setting to stop the spray(s) that do not have the application section within the application range included in the pretreatment information. For example, among the pieces of spray identification information that can uniquely identify each of the sprays, the CPU 11 stores only the spray identification information of the spray(s) to be operated, in the area of the RAM 13 that stores the control information of the application portion 40.

Figure 9:
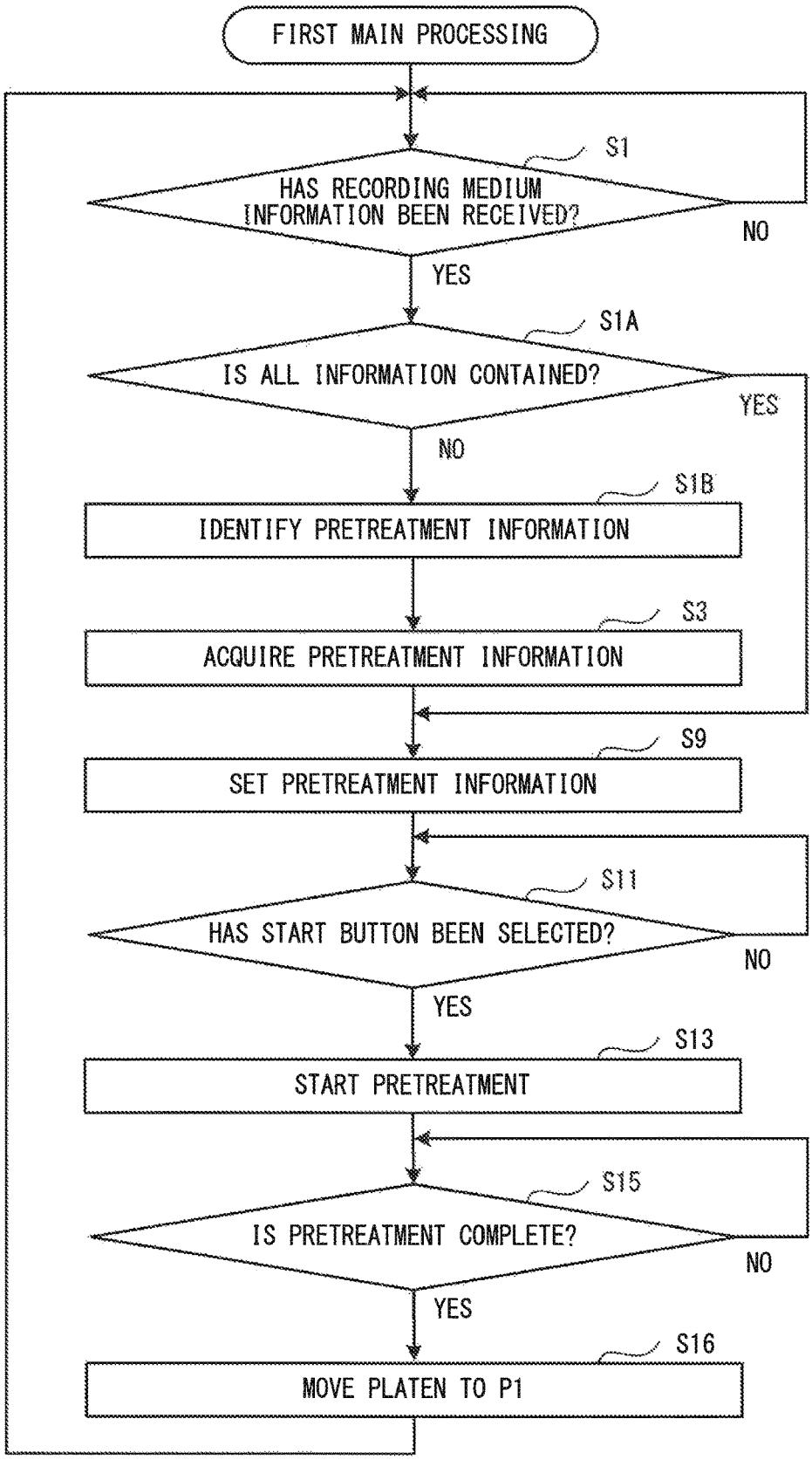
FIG. 9 is a flowchart showing a flow of first main processing.
Figure 15:
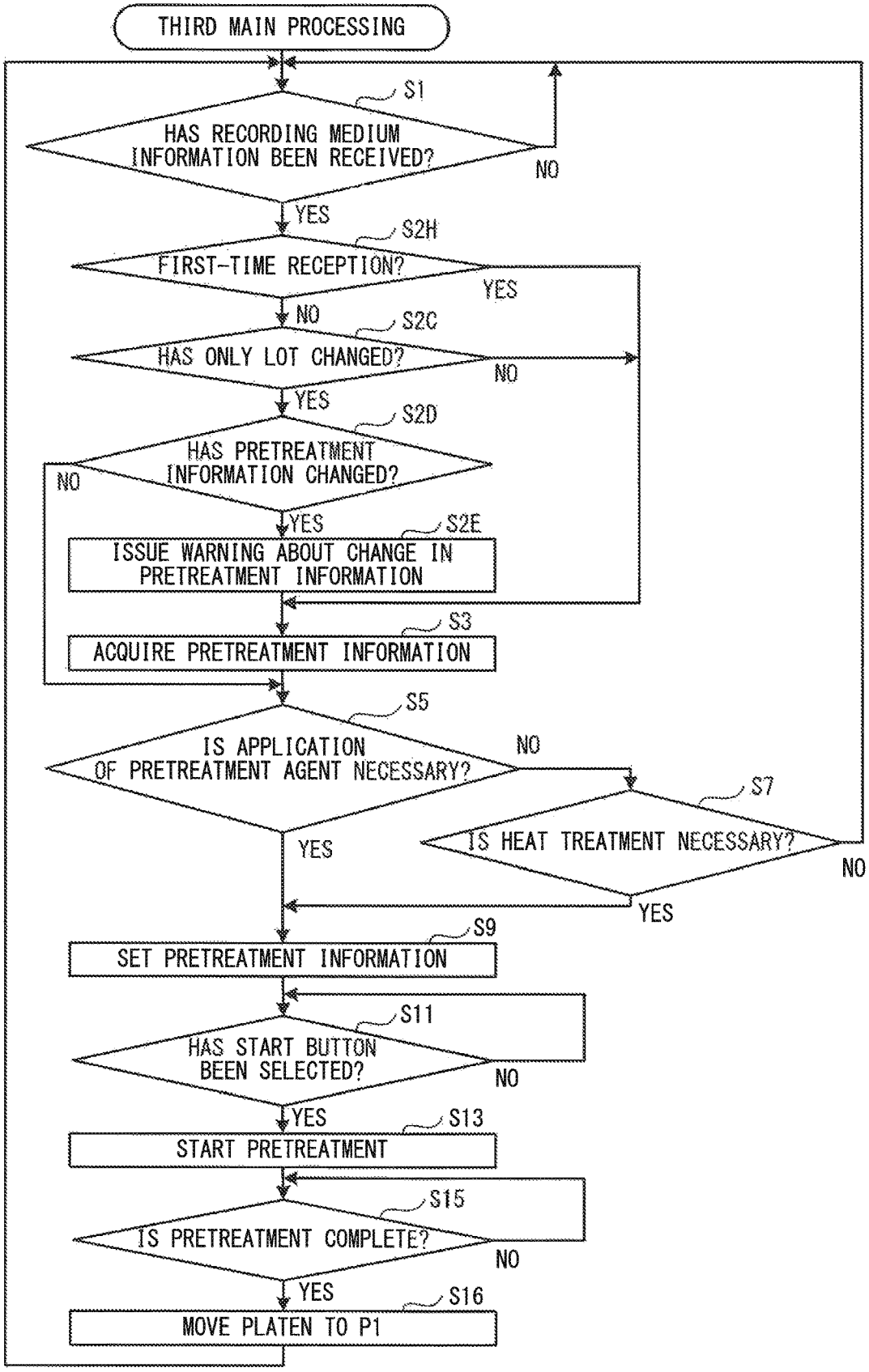
FIG. 15 is a flowchart showing a flow of third main processing.

The processing from step S11 to step S16 of the third main processing shown in FIG. 15 is the same as the processing from step S11 to step S16 of the first main processing shown in FIG. 9, and an explanation thereof is thus omitted here. When it is determined, in the processing at step S7, that the heat treatment is not necessary (no at step S7), the CPU 11 returns the processing to step S1.

Main Operations and Effects of Third Embodiment

When the pretreatment device 10 of the above-described third embodiment receives the recording medium information including the media information, the pretreatment device 10 refers to the fifth table 85, identifies the pretreatment information corresponding to the media information included in the recording medium information, and acquires the identified pretreatment information. The pretreatment device 10 sets the acquired pretreatment information for the pretreatment portion 70. In this way, the pretreatment device 10 receives the recording medium information that the recording medium has, and causes the pretreatment portion 70 to perform the pretreatment. It is thus possible to reduce the troublesomeness of the operator having to specify the pretreatment information.

The media information of the above-described third embodiment includes at least one of the manufacturing information and the material information. The pretreatment device 10 identifies the pretreatment information on the basis of at least one of the manufacturing information and the material information. Thus, the pretreatment device 10 can reduce the troublesomeness of the operator having to specify the pretreatment information.

The pretreatment device 10 of the above-described third embodiment compares the media information of the recording medium information received the previous time and the media information of the recording medium information received this time. When only the lot is different and the pretreatment information has changed, the pretreatment device 10 issues the warning about the change in the pretreatment information in advance. Therefore, even when there is no point of difference in the recording medium of the pretreatment target, the operator can know in advance that the setting of the pretreatment is to be changed. Therefore, it is possible to inhibit the operator from erroneously stopping the pretreatment device 10, and thus productivity of the pretreatment device 10 is improved.

When the color indicated by color information of the media information included in the received recording medium information corresponds to the specified color set in the sixth table 86, the pretreatment device 10 of the above-described third embodiment does not perform the pretreatment. Therefore, when the media information includes the information of the color for which the pretreatment is not necessary, the pretreatment device 10 does not perform the pretreatment. Thus, the productivity of the pretreatment device 10 is improved.

Even when the color indicated by the color information of the media information included in the received recording medium information corresponds to the specified color set in the sixth table 86, when the received recording medium information includes the heat treatment command, the pretreatment device 10 of the above-described third embodiment performs the heat treatment. Therefore, even when the media information includes the information of the color for which the pretreatment is not necessary, the pretreatment device 10 can perform the heat treatment according to need.

Fourth Embodiment

The configuration of the network 3 and the configurations of the pretreatment device 10 and the server 2 of a fourth embodiment are substantially the same as those of the third embodiment. Therefore, different portions will be explained and an explanation of portions that are the same as those of the third embodiment will be omitted here. In the fourth embodiment, the ROM 12 stores a fourth main processing program to be described later. Further, the flash memory 14 of the pretreatment device 10 stores the second table 82 and the sixth table 86. An external device, such as the HDD 204 of the server 2, stores the fourth table 84, and a seventh table 87 that will be described in detail later. In the fourth embodiment, the recording medium information includes the identifier.

Seventh Table 87

As shown in FIG. 13 and FIG. 16, the seventh table 87 is a table obtained by associating the identifiers with the fifth table 85.

Fourth Main Processing

Figure 17:
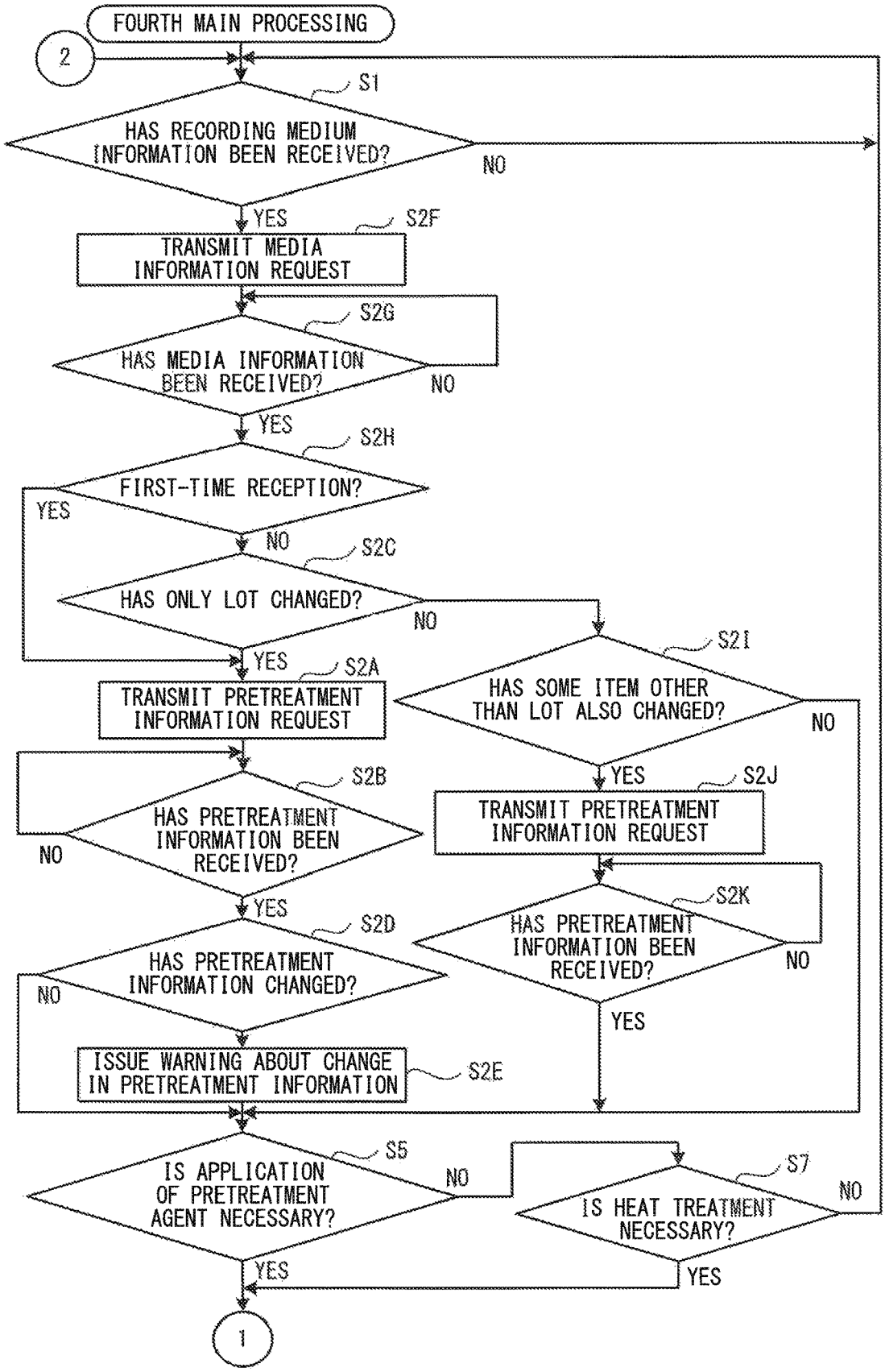
FIG. 17 is a part of a flowchart showing a flow of fourth main processing.
Figure 18:
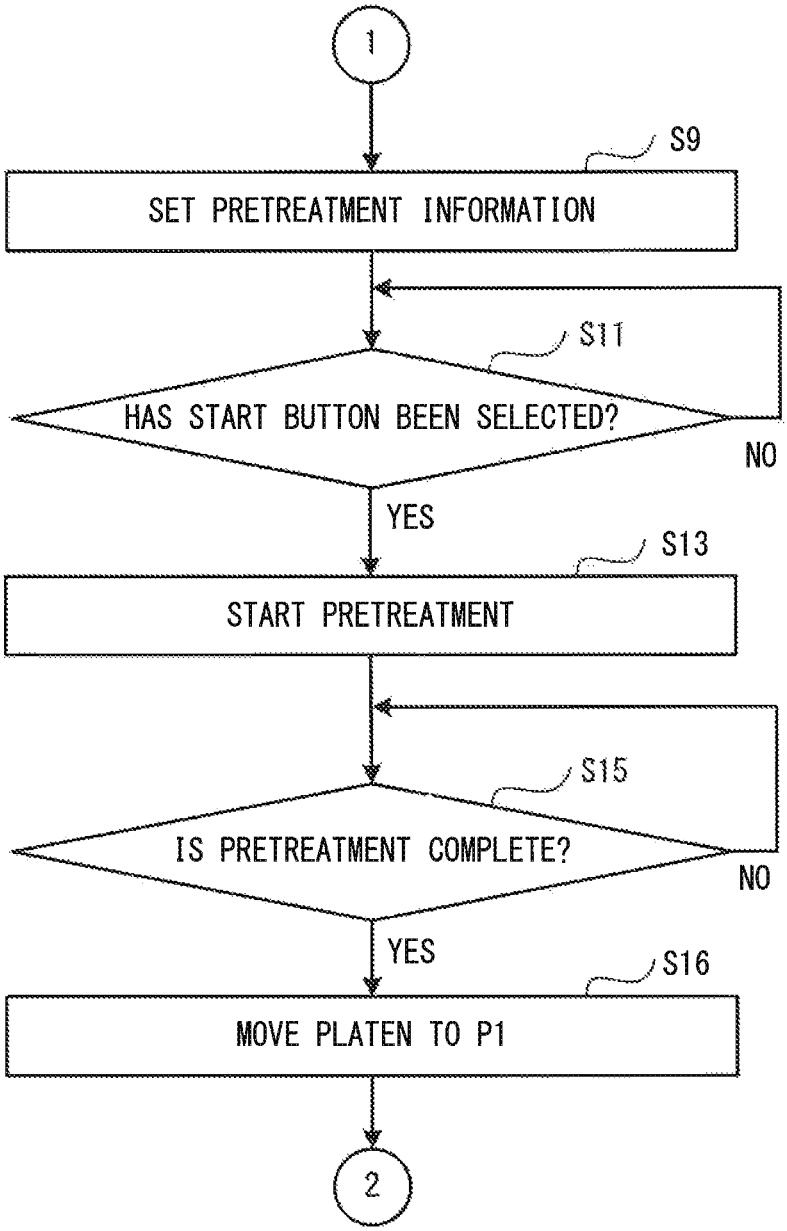
FIG. 18 is a remaining part of the flowchart showing the flow of the fourth main processing.

A flow of fourth main processing will be explained with reference to FIG. 17 and FIG. 18. The fourth main processing is performed when triggered by turning on the power source of the pretreatment device 10. The CPU 11 reads out the fourth main processing program from the ROM 12, and performs the fourth main processing using the RAM 13 as a working memory. In the fourth embodiment, as described above, the recording medium information includes the identifier.

First, the CPU 11 determines whether the recording medium information has been received (step S1). The processing at step S1 of the fourth main processing is the same as the processing at step S1 of the third main processing shown in FIG. 15, and an explanation thereof is thus omitted here. When it is determined that the recording medium information has not been received (no at step S1), the CPU 11 returns the processing to step S1 and repeats the processing at step S1. When it is determined that the recording medium information has been received (yes at step S1), the CPU 11 transmits, to the server 2, a media information request including the identifier included in the received recording medium information, via the communication portion 24 (step S2F).

The CPU 11 determines whether the media information transmitted from the server 2 has been received (step S2G). For example, the CPU 11 determines whether the media information has been input from the communication portion 24, and thus determines whether the media information has been received. When it is determined that the media information has not been received (no at step S2G), the CPU 11 repeats the processing at step S2G. When it is determined that the media information has been received (yes at step S2G), the CPU 11 determines whether it is the first-time reception of the recording medium information after the power source of the pretreatment device 10 has been turned on (step S2H). The processing at step S2H of the fourth main processing is the same as the processing at step S2H of the third main processing shown in FIG. 15, and a detailed explanation thereof is omitted here. When the CPU 11 determines that it is the first-time reception of the recording medium information (yes at step S2H), the CPU 11 advances the processing to step S2A.

When the CPU 11 determines that it is not the first-time reception of the recording medium information (no at step S2H), the CPU 11 performs comparison with the media information received the previous time and determines whether only the lot has changed in the media information (step S2C). For example, the CPU 11 compares the media information received the previous time and the media information received this time and determines whether a difference between the two pieces of media information is only the lot, thus determining whether only the lot has changed. When it is determined that only the lot has changed (yes at step S2C), the CPU 11 transmits, to the server 2, a pretreatment information request including the received media information or the identifier included in the received recording medium information, via the communication portion 24 (step S2A).

The CPU 11 determines whether the pretreatment information transmitted from the server 2 has been received (step S2B). For example, the CPU 11 determines whether the pretreatment information has been input from the communication portion 24, and thus determines whether the pretreatment information has been received. When it is determined that the pretreatment information has not been received (no at step S2B), the CPU 11 repeats the processing at step S2B. When it is determined that the pretreatment information has been received (yes at step S2B), the CPU 11 determines whether the received pretreatment information has changed (step S2D). For example, the CPU 11 performs comparison with the pretreatment information received the previous time and thus determines whether the pretreatment information received this time has changed.

When it is determined that the received pretreatment information has not changed (no at step S2D), the CPU 11 advances the processing to step S5. When it is determined that the received pretreatment information has changed (yes at step S2D), the CPU 11 issues a warning about the change in the pretreatment information (step S2E). At this time, for example, the CPU 11 controls the display portion 22 and causes the display portion 22 to display the change in the pretreatment information. The CPU 11 advances the processing to step S5.

In the processing at step S2C, when it is determined that some item other than the lot has also changed or the two pieces of media information are the same as each other (no at step S2C), the CPU 11 determines whether some item other than the lot has also changed (step S2I). For example, the CPU 11 compares the media information received the previous time and the media information received this time, and determines whether some item other than the lot has also changed, thus determining whether some item other than the lot has also changed. When it is determined that any item other than the lot has not changed, namely, that the two pieces of media information are the same as each other (no at step S2I), the CPU 11 advances the processing to step S5. When it is determined that some item other than the lot has also changed (yes at step S2I), the CPU 11 transmits, to the server 2, the pretreatment information request including the received media information or the identifier included in the received recording medium information, via the communication portion 24 (step S2J).

The CPU 11 determines whether the pretreatment information transmitted from the server 2 has been received (step S2K). For example, the CPU 11 determines whether the pretreatment information has been input from the communication portion 24, and thus determines whether the pretreatment information has been received. When it is determined that the pretreatment information has not been received (no at step S2K), the CPU 11 repeats the processing at step S2K. When it is determined that the pretreatment information has been received (yes at step S2K), the CPU 11 determines whether the application of the pretreatment agent is necessary, on the basis of the media information (step S5). The processing at step S5 of the fourth main processing is the same as the processing at step S5 of the third main processing shown in FIG. 15, and a detailed explanation thereof is thus omitted here. Further, the processing from step S5 to step S16 of the fourth main processing is the same as the processing from step S5 to step S16 of the third main processing shown in FIG. 15, and a detailed explanation thereof is thus omitted here.

Main Operations and Effects of Fourth Embodiment

When the pretreatment device 10 of the above-described fourth embodiment receives the recording medium information including the identifier, the pretreatment device 10 transmits the media information request including the identifier included in the recording medium information, to an external device, such as the server 2. The pretreatment device 10 compares the media information received the previous time and the media information received this time. When only the lot is different and when the pretreatment information has changed, the pretreatment device 10 issues the warning about the change in the pretreatment information, in advance. Therefore, even when there is no point of difference in the recording medium of the pretreatment target, the operator can know in advance that the setting of the pretreatment is to be changed. Therefore, it is possible to inhibit the operator from erroneously stopping the pretreatment device 10, and thus the productivity of the pretreatment device 10 is improved.

When the pretreatment device 10 of the above-described fourth embodiment receives the recording medium information including the identifier, the pretreatment device 10 transmits the media information request including the identifier included in the recording medium information, to an external device, such as the server 2, and acquires the media information The pretreatment device 10 transmits the pretreatment information request including the acquired media information or the identifier to an external device, such as the server 2, and acquires the pretreatment information. The pretreatment device 10 sets the acquired pretreatment information for the pretreatment portion 70. Therefore, by simply receiving the recording medium information that the recording medium has, the pretreatment device 10 causes the pretreatment portion 70 to perform the pretreatment. It is thus possible to reduce the troublesomeness of the operator having to specify the pretreatment information.

Fifth Embodiment

The configuration of the network 3 and the configurations of the pretreatment device 10 and the server 2 of a fifth embodiment are substantially the same as those of the first embodiment. Therefore, different portions will be explained and an explanation of portions that are the same as those of the first embodiment will be omitted here. In the fifth embodiment, the ROM 12 stores a fifth main processing program. Further, the flash memory 14 stores the second table 82 and the default pretreatment information excluding a pretreatment range. An external device, such as the HDD 204 of the server 2, stores an eighth table 88. In the fifth embodiment, the recording medium information includes the identifier.

Eighth Table 88

As shown in FIG. 19, the eighth table 88 is a table in which the identifiers and the print data are associated with each other. The identifier is information that can uniquely identify the cloth, which is the recording medium. Since the identifier can uniquely identify the recording medium, the eighth table 88 associates the recording medium with the print data of the recording medium. Therefore, the identifier is also information that can uniquely identify the print data.

Fifth Main Processing

Figure 20:
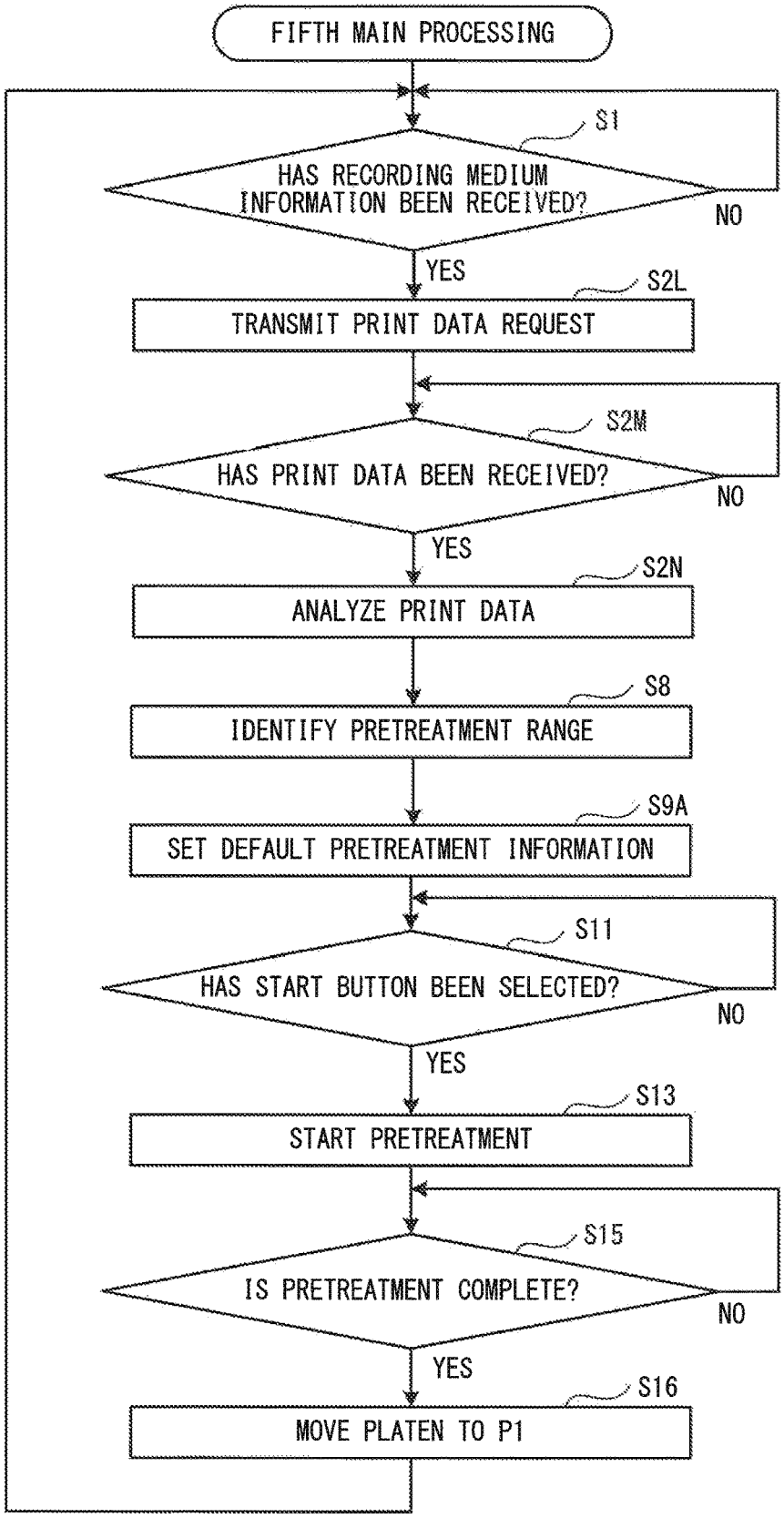
FIG. 20 is a flowchart showing a flow of fifth main processing.

A flow of fifth main processing will be explained with reference to FIG. 20. The fifth main processing is performed when triggered by turning on the power source of the pretreatment device 10. The CPU 11 reads out the fifth main processing program from the flash memory 14, and performs the fifth main processing using the RAM 13 as a working memory. In the fifth embodiment, as described above, the recording medium information includes the identifier.

First, the CPU 11 determines whether the recording medium information has been received (step S1). The processing at step S1 of the fifth main processing is the same as the processing at step S1 of the first main processing shown in FIG. 9, and an explanation thereof is thus omitted here. When it is determined that the recording medium information has not been received (no at step S1), the CPU 11 returns the processing to step S1 and repeats the processing at step S1. When it is determined that the recording medium information has been received (yes at step S1), the CPU 11 transmits, to the server 2, a print data request including the identifier included in the received recording medium information, via the communication portion 24 (step S2L).

The CPU 11 determines whether the print data transmitted from the server 2 has been received (step S2M). For example, the CPU 11 determines whether the print data has been input from the communication portion 24, and thus determines whether the print data has been received. When it is determined that the print data has not been received (no at step S2M), the CPU 11 repeats the processing at step S2M. When it is determined that the print data has been received (yes at step S2M), the CPU 11 anaylizes the received print data (step S2N). For example, the CPU 11 analyzes arrangement information of image data included in the received print data, and identifies the arrangement information The CPU 11 identifies the pretreatment range on the basis of the identified arrangement information of the image data (step S2N). A method for identifying the pretreatment range will be explained specifically. For example, it is assumed that an image corresponding to the image data included in the print data is a black star shown in FIG. 7. The print data includes the arrangement information of the image on the platen 31 of the pretreatment device 10. Therefore, on the basis of the arrangement information, the CPU 11 can acquire the XY coordinates on the platen 31 of respective points of an outer edge of the image. The CPU 11 identifies the divided regions (divided into 7×18 regions in the examples shown in FIG. 7 and FIG. 8) in which the acquired XY coordinates are included. At the time of the identification, it is desirable to identify regions including the XY coordinates of the black star that is enlarged at a given enlargement ratio. The CPU 11 identifies a region surrounded by the identified regions, as the application range. The method for identifying the heat treatment range is the same as that described above in the explanation of FIG. 7 and FIG. 8.

The CPU 11 acquires the default pretreatment information excluding the pretreatment range from the flash memory 14, and sets the acquired pretreatment information and the identified pretreatment range, for the pretreatment portion 70 (step S9A). For example, the CPU 11 stores the application treatment information of the acquired pretreatment information and the information of the identified pretreatment range in the area of the RAM 13 that stores the control information of the application portion 40, and stores the heat treatment information in the area of the RAM 13 that stores the control information of the heat treatment portion 50. At this time, for the application portion 40, the CPU 11 performs the setting to stop the spray(s) that do not have the application section within the application range included in the pretreatment information. For example, among the pieces of spray identification information that can uniquely identify each of the sprays, the CPU 11 stores only the spray identification information of the spray(s) to be operated, in the area of the RAM 13 that stores the control information of the application portion 40.

The processing from step S11 to step S16 of the fifth main processing is the same as the processing from step S11 to step S16 of the first main processing shown in FIG. 9, and an explanation thereof is thus omitted here.

Main Operations and Effects of Fifth Embodiment

When the pretreatment device 10 of the above-described fifth embodiment receives the recording medium information, the pretreatment device 10 identifies the pretreatment range on the basis of the received recording medium information. Thus, the pretreatment device 10 can reduce the troublesomeness of the operator having to specify the pretreatment range.

When the pretreatment device 10 of the above-described fifth embodiment receives the recording medium information including the identifier, the pretreatment device 10 transmits the print data request including the identifier included in the recording medium information, to an external device, such as the server 2, and acquires the print data. The pretreatment device 10 identifies the pretreatment range on the basis of the acquired print data. Therefore, the pretreatment device 10 can perform the appropriate pretreatment on the basis of the print data.

The pretreatment device 10 of the above-described fifth embodiment identifies the pretreatment range on the basis of the print data. Therefore, the pretreatment device 10 can perform the appropriate pretreatment on the basis of the print data.

The pretreatment device 10 of the above-described fifth embodiment identifies the pretreatment range on the basis of the arrangement information of the image with respect to the platen 31, of the image data included in the print data. Therefore, the pretreatment device 10 can perform the appropriate pretreatment on the basis of the print data.

Modified Examples

The steps of each processing of the first embodiment to the fifth embodiment can be combined or rearranged, as long as there is no contradiction. Further, the order of the steps may be interchanged, as long as there is no contradiction. Further, the pretreatment device 10 may execute any combination of the embodiments among the first embodiment to the fifth embodiment. Further, the pretreatment apparatus 10 may execute all of the first embodiment to the fifth embodiment.

The application amount per unit area (mg/cm$^2$) of the pretreatment agent in the first to fifth embodiments may be an application amount over a predetermined area, or may be an application amount over the application range. In this case, the application amount per unit area (mg/cm$^2$) may be calculated on the basis of the received application amount.

The recording medium information may include the information of the application amount, and the pretreatment device 10 may set the heat treatment information on the basis of the application amount included in the recording medium information. For example, the pretreatment device 10 automatically sets the heat treatment time period (sec) that is proportional to the application amount.

In the processing at step S1B of the first main processing, it is explained that when the CPU 11 cannot identify the pretreatment information that completely matches the pretreatment information included in the recording medium information, the CPU 11 identifies the lacking pretreatment information from the default pretreatment information stored in the flash memory 14. However, the default pretreatment information need not necessarily be stored in the flash memory 14. In this case, the CPU 11 identifies the pretreatment information that is closest to the pretreatment information included in the recording medium information, from the list of the pretreatment information in the first table 81.

The pretreatment device 10 of the above-described fifth embodiment acquires the print data from an external device, such as the server 2. However, the flash memory 14 of the pretreatment device 10 may hold the eighth table 88 and may acquire the print data from the eighth table 88.

In the second embodiment, an external device, such as the HDD 204 of the server 2, may store the third table 83 and the fourth table 84. In this case, when the pretreatment device 10 receives the recording medium information including the identifier, the pretreatment device 10 transmits the pretreatment information request including the identifier included in the recording medium information, to an external device that holds the pretreatment information, such as the server 2. The pretreatment device 10 sets, for the pretreatment portion 70, the pretreatment information sent back from the external device that holds the pretreatment information, such as the server 2. In this way, the pretreatment device 10 receives the recording medium information that the recording medium has, and causes the pretreatment portion 70 to perform the pretreatment. It is thus possible to reduce the troublesomeness of the operator having to specify the pretreatment information.

In the above-described embodiments, it is explained that the identifier uniquely identifies the cloth. However, the identifier may uniquely identify the pretreatment information, the print data or the like. For example, when the identifier uniquely identifies the pretreatment information, the pretreatment device 10 may receive the recording medium information including the identifier, and may identify the pretreatment information on the basis of the identifier included in the recording medium information. Further, for example, when the identifier uniquely identifies the print data, the pretreatment device 10 receives the recording medium information including the identifier, and identifies the print data on the basis of the identifier included in the recording medium information. The pretreatment device 10 may analyze the arrangement information of the image in the identified print data, and may identify the pretreatment range on the basis of the print data.

The pretreatment device 10 of the first to fifth embodiments may be provided with a print portion 10A capable of printing on the recording medium of the pretreatment target.

The external device of the third to fifth embodiments is explained using the server 2 as an example. However, the external device may be the printer 1 or may be a terminal device (not shown in the drawings). Examples of the terminal device include a personal computer (PC), a smart phone, a tablet and the like.

The pretreatment device 10 of the above-described fifth embodiment identifies the pretreatment range on the basis of the arrangement information of the image with respect to the platen 31, of the image data included in the print data. Therefore, the pretreatment device 10 can perform the appropriate pretreatment on the basis of the print data.

In the processing at step S9 or step S9A of the first to fifth main processing, at least one of the application amount per unit area (mg/cm$^2$) of the pretreatment agent and the type of the pretreatment agent may be set for the application portion 40, as the application treatment information. In this way, the pretreatment device 10 can reduce the troublesomeness of the operator having to specify the application treatment information including at least one of the type of the pretreatment agent and the application amount per unit area ($mg/cm^2$) of the pretreatment agent.

In the processing at step S9 or step S9A of the first to fifth main processing, at least one of the heat treatment pressure ($N/cm^2$), the heat treatment time period (sec), the heat treatment temperature (° C.) and the number of times of the heat treatment may be set for the heat treatment portion 50, as the heat treatment information. In this way, the pretreatment device 10 can reduce the troublesomeness of the operator having to specify the heat treatment information including at least one of the heat treatment pressure ($N/cm^2$), the heat treatment time period (sec), the heat treatment temperature (° C.) and the number of times of the heat treatment. Further, setting at least one of the heat treatment pressure (N/cm2), the heat treatment time period (sec), the heat treatment temperature (° C.) and the number of times of the heat treatment, for the heat treatment portion 50, and setting at least one of the application amount per unit area (mg/cm2) of the pretreatment agent and the type of the pretreatment agent, for the application portion 40, as the application treatment information, may be combined.

The heat treatment portion 50 of the first to fifth embodiments may be provided with a heat press portion 51, and in the processing at step S9 or step S9A of the main processing, at least one of a heat press pressure ($N/cm^2$), a heat press time period (sec), a heat press temperature (° C.) and a number of times of a heat press operation may be set for the heat treatment portion 50, as the heat treatment information. In this way, the pretreatment device 10 can reduce the troublesomeness of the operator having to specify the heat treatment information including at least one of the heat press pressure ($N/cm^2$), the heat press time period (sec), the heat press temperature (° C.) and the number of times of the heat press operation.

The programs and the like used to execute the main processing and the like may be stored in a disk device or the like provided in a server device on the Internet, and the pretreatment device 10 and the server 2 may download various programs.

According to the embodiments or the modified examples, the pretreatment device 10 and the server 2 may use other types of storage device other than a ROM and a RAM. For example, the pretreatment device 10 and the server 2 may have a storage device, such as a content addressable memory (CAM), an SRAM, an SDRAM or the like.

According to the embodiments or the modified examples, the electrical configurations of the pretreatment device 10 and the server 2 may be different from those shown in FIG. 3 and FIG. 4. Other hardware having a standard/type other than that illustrated in FIG. 3 and FIG. 4 may be applied to the pretreatment device 10 and the server 2.

For example, the control portion of the pretreatment device 10 shown in FIG. 3 and the control portion of the serer 2 shown in FIG. 4 may be configured by a hardware circuit. For example, instead of at least one of the CPU 11 and the CPU 201, the control portion may be configured by a reconfigurable circuit, such as an FPGA, or an ASIC. The control portion may be configured by both the hardware circuit and the CPU 11 or the CPU 201.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A pretreatment device comprising:

a pretreatment portion configured to perform a pretreatment on a recording medium;

a reception portion configured to receive recording medium information that the recording medium has;

a processor; and a memory storing computer-readable instructions that, when executed by the processor, perform processes including:

setting, for the pretreatment portion, pretreatment information relating to the pretreatment, on the basis of the recording medium information received by the reception portion; and causing the pretreatment portion to perform the pretreatment on the basis of the set pretreatment information, wherein the setting of the pretreatment information for the pretreatment portion includes setting a pretreatment area on the recording medium on the basis of the recording medium information.

2. The pretreatment device according to claim 1, wherein the setting of the pretreatment information for the pretreatment portion includes setting the pretreatment area on the basis of print data corresponding to the recording medium information.

3. The pretreatment device according to claim 2, wherein the setting of the pretreatment information for the pretreatment portion includes setting the pretreatment area on the basis of arrangement information of an image with respect to the recording medium included in the print data.

4. The pretreatment device according to claim 1, wherein the pretreatment portion includes an application portion configured to apply a pretreatment agent, the setting of the pretreatment information for the pretreatment portion includes setting, for the application portion, application treatment information as the pretreatment information, on the basis of the recording medium information.

5. The pretreatment device according to claim 4, wherein the setting of the pretreatment information for the pretreatment portion includes setting, for the application portion, at least one of a type of the pretreatment agent and an application amount of the pretreatment agent, as the application treatment information.

6. The pretreatment device according to claim 1, wherein the pretreatment portion includes a heat treatment portion configured to perform heat treatment on the recording medium, and the setting of the pretreatment information for the pretreatment portion includes setting, for the heat treatment portion, heat treatment information on the basis of the recording medium information.

7. The pretreatment device according to claim 6, wherein the setting of the pretreatment information for the pretreatment portion includes setting, for the heat treatment portion, at least one of a heat treatment temperature, a heat treatment time period and a number of times of heat treatment, as the heat treatment information.

8. The pretreatment device according to claim 6, wherein the heat treatment portion includes a heat press portion, and the setting of the pretreatment information for the pretreatment portion includes, setting, for the heat treatment portion, at least one of a heat press temperature, a heat press time period, a heat press pressure and a number of times of a heat press operation, as the heat treatment information.

9. The pretreatment device according to claim 1, wherein the recording medium information includes at least one of material information, which is information relating to a material of the recording medium, and manufacturing information, which is information relating to manufacture of the recording medium, and the setting of the pretreatment information for the pretreatment portion includes setting, for the pretreatment portion, the pretreatment information on the basis of at least one of the material information and the manufacturing information.

10. The pretreatment device according to claim 9, wherein the material information includes color information of the recording medium, and the computer-readable instructions further perform processes including:

determining whether to perform the pretreatment on the basis of the color information; and causing the pretreatment not to be performed when it is determined that the pretreatment is not to be performed.

11. The pretreatment device according to claim 1, wherein the recording medium information includes an identifier, and the setting of the pretreatment information for the pretreatment portion includes setting, for the pretreatment portion, the pretreatment information on the basis of the identifier.

12. The pretreatment device according to claim 11, wherein the setting of the pretreatment information for the pretreatment portion includes, setting, for the pretreatment portion, the pretreatment information corresponding to the identifier included in the recording medium information acquired from a storage portion and received by the reception portion, the storage portion being configured to associate and store the identifier and the pretreatment information.

13. The pretreatment device according to claim 1, wherein the recording medium information includes an identifier, and the setting of the pretreatment information for the pretreatment portion includes setting a pretreatment area on the basis of print data corresponding to the identifier included in the recording medium information acquired from an external device and received by the reception portion, the external device being configured to associate and store the identifier and the print data.

14. The pretreatment device according to claim 13, wherein the external device is a server.

15. The pretreatment device according to claim 1, further comprising:

a print portion configured to perform printing on the recording medium.

16. A pretreatment information setting method for a pretreatment device including a pretreatment portion configured to perform a pretreatment on a recording medium, a reception portion configured to receive recording medium information, and a control portion configured to control the pretreatment device, the method comprising the steps of:

using the control portion to set, for the pretreatment portion, pretreatment information relating to the pretreatment, on the basis of the recording medium information received by the reception portion; and using the control portion to cause the pretreatment portion to perform the pretreatment on the basis of the set pretreatment information, wherein the setting of the pretreatment information for the pretreatment portion includes setting a pretreatment area on the recording medium on the basis of the recording medium information.

17. A pretreatment device comprising:

a pretreatment portion configured to perform a pretreatment on a recording medium;

a reception portion configured to receive recording medium information that the recording medium has;

a processor; and a memory storing computer-readable instructions that, when executed by the processor, perform processes including:

setting, for the pretreatment portion, pretreatment information relating to the pretreatment, on the basis of the recording medium information received by the reception portion; and causing the pretreatment portion to perform the pretreatment on the basis of the set pretreatment information, wherein the recording medium information includes at least one of material information, which is information relating to a material of the recording medium, and manufacturing information, which is information relating to manufacture of the recording medium, the setting of the pretreatment information for the pretreatment portion includes setting, for the pretreatment portion, the pretreatment information on the basis of at least one of the material information and the manufacturing information, the material information includes color information of the recording medium, the computer-readable instructions further perform processes including:

determining whether to perform the pretreatment on the basis of the color information; and causing the pretreatment not to be performed when it is determined that the pretreatment is not to be performed.

* * * * *